US008859953B2

(12) United States Patent
Baykut et al.

(10) Patent No.: US 8,859,953 B2
(45) Date of Patent: Oct. 14, 2014

(54) CORRECTION OF ASYMMETRIC ELECTRIC FIELDS IN ION CYCLOTRON RESONANCE CELLS

(71) Applicant: Bruker Daltonik GmbH, Bremen (DE)

(72) Inventors: Goekhan Baykut, Bremen (DE); Jochen Friedrich, Bremen (DE); Roland Jertz, Bremen (DE); Claudia Kriete, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 13/767,595

(22) Filed: Feb. 14, 2013

(65) Prior Publication Data

US 2014/0224972 A1 Aug. 14, 2014

(51) Int. Cl.
*H01J 49/00* (2006.01)

(52) U.S. Cl.
CPC ..... *H01J 49/0009* (2013.01)
USPC ..... 250/282; 250/281; 250/290; 250/291; 250/300

(58) Field of Classification Search
USPC ..... 250/281, 282, 290, 291, 300
See application file for complete search history.

(56) References Cited

U.S. PATENT DOCUMENTS

2009/0302209 A1* 12/2009 Green et al. ..... 250/282

FOREIGN PATENT DOCUMENTS

WO 2011045144 4/2011

OTHER PUBLICATIONS

Hanson et al., "Field-Corrected Ion Cell for Ion Cyclotron Resonance", Analytical Chemistry, vol. 62, No. 5, Mar. 1, 1990, pp. 520-526.

Nikolaev et al., "Analysis of harmonics for an elongated FTMS cell with multiple electrode detection", International Journal of Mass Spectrometry and Ion Processes 157/158, 1996, pp. 215-232.

* cited by examiner

*Primary Examiner* — Nicole Ippolito
(74) *Attorney, Agent, or Firm* — O'Shea Getz P.C.

(57) ABSTRACT

The invention relates to a method and a device for optimization of electric fields in measurement cells of Fourier transform ion cyclotron resonance mass spectrometers. The invention is based on the rationale that asymmetric electric fields with uniformly or non-uniformly perturbed field axes can appear in ion cyclotron resonance cells and therefore the axis of the magnetron orbit can become radially displaced. Shifted magnetron orbits negatively affect the cyclotron excitation, deteriorate the FT-ICR signal, increase the intensity of an even-numbered harmonics peak, lead to stronger side bands of the FT-ICR signal, and in extreme cases, cause loss of ions. The present invention helps in probing the shift of the magnetron motion, detecting parameters indicative of the offset of the electric field axis and/or correcting it by trimming it back to the geometric axis of the cell.

20 Claims, 13 Drawing Sheets

CORRECTION OF ASYMMETRIC ELECTRIC FIELDS IN ION CYCLOTRON RESONANCE CELLS

FIELD OF THE INVENTION

The invention relates to methods and devices for the compensation of asymmetric electric fields in the measurement cells of Fourier transform ion cyclotron resonance mass spectrometers (FT-ICR MS).

BACKGROUND OF THE INVENTION

The cyclotron radius $r_c$ of an ion with the mass m, the elementary charge e, the charge number z, and the kinetic energy $E_{kin}$ in a magnetic field of the flux density B is given by the following equation:

$$r_c = \frac{\sqrt{2mE_{kin}}}{zeB} \tag{1}$$

In the thermal energy range, e.g., at a temperature of 298 K, and in a magnetic field with the flux density of 7 Tesla, the cyclotron radius of a singly charged ion with mass 1,000 dalton is approximately a tenth of a millimeter. Normally, the ICR cell contains a large number of ions, and their masses can be quite different. Before detection, the cyclotron motion of the ions is excited by an oscillating (RF) electric field with a scanned frequency ("Chirp"). When the frequency of the scanned oscillating field becomes equal to the cyclotron frequency $$\nu_c = \frac{zeB}{2\pi m} \tag{2}$$

of an ion with mass m and charge number z, its cyclotron motion gets resonantly excited. In this equation e is the elementary charge. Depending on the duration and the amplitude of the irradiated field, ions become accelerated and move to larger (excited) cyclotron orbits. This resonant excitation also forces ions with the same charge number-related mass (m/z), which initially circle randomly on small cyclotron orbits having completely different phases, to a completely coherent motion. At the end of the excitation process ions with the same charge number-related mass (m/z) form a cloud in which all ions move in phase. Coherently moving ions in this excited cloud induce image charges of the same magnitude at the detection electrodes that oscillate with the same frequency and with the same phase. Such oscillating image charges (image currents) generated by all excited ion clouds are recorded, amplified, and after Fourier transformation displayed as a frequency spectrum or, when a frequency to mass mapping exists, as a mass spectrum.

The magnetic field can only trap ions in the plane perpendicular to the magnetic field lines so that they cannot radially escape the cell. To prevent the ions from escaping in the axial direction, an electric trapping field is required. Therefore, axially, at both ends of the cell, end electrodes (or end plates) are placed on which a relatively low DC voltage (normally, 1-2 volts) is applied. The polarity of this DC voltage is the same as the ions to be trapped. The mantle electrodes of a simple conventional cylindrical ICR cell are grounded, thus, an electric trapping field is formed in the cell between the end electrodes and the cylinder mantle. Ions with the mass m and the charge number z oscillate axially in the cell of the length a between the two end electrodes with a trapping frequency $\nu_T$ if a trapping voltage $V_T$ is applied:

$$\nu_T = \frac{1}{2\pi}\sqrt{\frac{2azeV_T}{ma^2}}. \tag{3}$$

Here e is the elementary charge, and $\alpha$ a constant depending on the cell geometry. With this additional oscillation the ion performs a combination of three independent periodic motions in the cell: cyclotron and magnetron motions in the radial plane, and the trapping oscillations in the axial direction.

Although the applied electric trapping field helps keeping the ions from escaping the cell, it definitely deteriorates the conditions for a clean measurement of the cyclotron frequency. Due to the radial components of the trapping field, the ions do not only circle on their pure cyclotron orbits. As a superimposed motion they follow epicycloidal magnetron orbits and they additionally oscillate in the axial direction with the trapping frequency. The magnetron motion is very slow compared to the cyclotron motion. Its frequency only depends on the magnetic field and the electric field. The size (or diameter) of the initial magnetron orbits of ions in the cell right after they are captured depends on how the ions are transferred to the cell: transferred by an electrostatic ion transfer optics or by an RF-multipole transfer optics, or whether or not they are captured using an electric field pulse orthogonal to their path and to the magnetic field ("sidekick"), etc. The initial magnetron radii are normally small, but they can be increased by asymmetric magnetic or electric fields that may excite the magnetron motion. A resistive detection circuit can also induce an increase in magnetron radii due to loss of the potential energy by image current damping.

In the presence of a trapping field, the frequency measured at the detection electrodes of the cell is no longer the unperturbed cyclotron frequency $\nu_c$ but the reduced cyclotron frequency $\nu_R$:

$$\nu_R = \frac{\nu_c}{2} + \sqrt{\frac{\nu_c^2}{4} - \frac{\nu_T^2}{2}}, \tag{4}$$

which is smaller by a magnetron frequency $\nu_M$ than the unperturbed cyclotron frequency:

$$\nu_R = \nu_c - \nu_M. \tag{5}$$

The magnetron frequency of an ion of cyclotron frequency $\nu_c$ and a trapping frequency $\nu_T$ is:

$$\nu_M = \frac{\nu_c}{2} - \sqrt{\frac{\nu_c^2}{4} - \frac{\nu_T^2}{2}}. \tag{6}$$

FIG. 1 shows the combined motion of an ion in an ICR cell in the magnetic field of the flux density B 1. The combination of the cyclotron motion 2, the trapping oscillation 3, of which the sinusoidal curve is shown in dashed lines 4, and the magnetron motion 5 produces the complicated resulting motion 6 of the ion around the electric field axis 7. When an ion is axially introduced exactly in the middle of the ICR cell, it should normally not experience any electric field component perpendicular to its path. The radial components of the electric trapping field are distributed symmetrically around the axis of the DC electric field, i.e., normally around the axis of the cell. Thus, there is no perpendicular electric field component at the cell axis. However, if the electric field axis is, for some reason, displaced and does not coincide with the axis of the cell, a perpendicular electric field component does exist at the cell axis. An ion that is introduced on axis into the cell now experiences this field component, and the influence of the E×B fields immediately diverts it from its initial path. The ion now drifts perpendicular to both the magnetic field and that radial electric field component into the third dimension and starts an epicycloidal orbit that winds on a circle around the offset electric field axis. This is a magnetron orbit with an offset axis in reference to the cell axis. The magnetron radius is basically equal to the displacement of the electric field axis.

FIG. 2*a* is a partial drawing of a trapping plate 21 of an ICR cell with the ion introduction hole 20. The electric field axis 23 does not coincide here with the geometric axis 30 of the cell, and the radial electric field components 22 make the ion start moving on an epicycloidal 25 magnetron orbit around the electric field axis 23. The virtual magnetron circle 26 is shown in dashed lines. The magnetron radius is here equal to the displacement 27 of the electric field. Element 24 indicates the direction of the magnetic field lines being aligned perpendicular to the plane of illustration.

FIG. 2*b* shows an electric field axis 23*a* that is displaced by a much smaller amount 27*a* than in FIG. 2*a*. In this case, the ion entering the cell on axis is also influenced by the radial field components 22*a* and moves on a smaller magnetron orbit 25*a* around the displaced field axis. The virtual magnetron circle is here also shown in dashed lines 26*a* and has the same magnitude as the displacement 27*a* of the electric field. It is to be noted that the displacement of the field axis as well as the complete magnetron orbit 25*a* remains here within the limits of the ion introduction hole 20 of the ICR cell.

In a trapping field which is asymmetric and not concentric with the cell, severely shifted magnetron orbits can be formed, on which ions can come very close to the mantle electrodes. During a cyclotron excitation on such a shifted magnetron orbit, ions can hit the cell walls and be lost before they are detected.

An asymmetry of the electric field inside the FT-ICR cell can be a consequence of many different effects. Some of them are discussed in the following.

A deviation of individual electrode shapes from the calculated ideal shapes or a deviation of the assembled cell from its ideal shape can cause asymmetry of the electric field inside the cell. Most of the conventional cylindrical cells have only four cell mantle electrodes which are cylindrically bent rectangular electrodes, and their end electrodes are flat circle shaped parts (see 205 and 206 in FIG. 10*a*). Although these shapes are mostly straightforward, deviations from perfect shapes can still occur if the tolerances are not correctly defined, if the individual electrodes are not cut out of one and the same cylindrical raw material, or if the assembly of the cell is not perfect. In the FT-ICR cells of more complex nature this remains a challenge. Cylindrical cells specially made for high resolution acquisitions contain, for example, more than one detection electrode pair for detection of multiples of the cyclotron frequency. Some of them can have 16 cylinder mantle electrodes which need to be manufactured and assembled within very narrow tolerances. There is a non-zero probability that some individual electrodes of a multitude of mantle electrodes of an ICR cell may deviate to a different extent from the corresponding ideal shape and/or alignment so that the ensuing perturbation of the desired ideal electric field axis could also be non-uniform, for instance, in that a radial shift of the electric field center varies along the longitudinal extension of the cell.

Manufacturing tolerances of parts, as well as deviations from precise assembly in case of compensated cylindrical FT-ICR cells which usually contain 28 or 36 cylinder mantle electrodes (7-section and 9-section cells are known in the art) can influence the electric field symmetry throughout the cell.

Dynamically harmonized cells do have a specially shaped cylinder mantle which usually contains 20 or more cylinder mantle electrodes. If the tolerances of the electrodes are not correctly kept, or if the final assembly of so many electrodes is not perfectly performed these cells are also susceptible to generate electric field errors inside. In a simplest case these field errors can lead to a parallel displacement of the electric field axis from the geometric axis of the cell (uniform perturbation). In more complicated cases, however, these field errors could also lead to at least one of a tilting (the electric field axis and geometric axis of the ICR cell are not parallel any more), a bending (the electric field axis is not a straight line any more, but a non-linear 2D or 3D curve), and a rippling (the electric axis comprises a stepped pattern with abrupt shifts where a perturbation changes significantly) of the electric field axis (non-uniform perturbation).

FIG. 3*a* shows an example for a dynamically harmonized ICR cell (50), known from the patent application WO 2011/045144 A1 (E. Nikolaev and I. Boldin). This cell has leaf-shaped (e.g. 58) and inverse leaf-shaped e.g., 55, 57, 59, 61 cylinder mantle electrodes. In FIG. 3*a*, the letter X denotes the cell axis. In order to divide the cell mantle into four equal 90°-segments, four of the eight leaf electrodes are longitudinally divided into two halves e.g., 56*a* and 56*b*. Thus the cell has four integral leaf electrodes, four split leaf electrodes, and eight inverse leaf electrodes.

FIG. 3*b* displays the cylinder mantle electrodes open and unwound. There are two excitation segments E consisting of 5 electrodes 60*b*, 61, 62, 63, 64*a* and 69*b*, 70, 71, 72, 56*a*. Furthermore, there are two detection segments consisting of 5 electrodes 56*b*, 57, 58, 59, 60*a* and 65*b*, 66, 67, 68, 69*a*. In the detection segments often only the leaf and half leaf electrodes 56*b*, 58, 60*a* and 65*b*, 67, 69*b* are used. The inverse leaf electrodes 57, 59, 66 and 68 are normally not used as detection electrodes since these are connected to DC voltage power supplies and thus lead to noisy ICR signals. However, if the DC voltages are generated by a battery, the noise can be avoided, and all five electrodes in a detection segment can be used for signal detection. All inverse leaf plates may be supplied with a common variable DC voltage which normally does not differ too much from the trapping voltage of the end electrodes 80 and 81 of the cell.

Another cause of symmetry errors of the electric field inside the ICR cell may originate from the contact potentials of connectors from the power supply. The contact potentials can change the effective potentials appearing on the individual electrodes, and they can be slightly different from the voltages applied by the user at the instrument console. Depending on the location of these contact potential effects this problem can cause asymmetric electric field inside the cell.

Asymmetric electric fields in the ICR cell can also be a consequence of charging up of individual electrodes. Charging is a general process, which can appear due to various reasons. One of the reasons for electrode charging can be a high resistive connection of this electrode to the ground. Normally, after every acquisition cycle, the detection electrodes in the cell should be at ground potential. However, if they are connected to the ground over a large resistor, which is essential to pick up the extremely low induced image charge signal, this can make it difficult to have a quick and easy discharge after every acquisition cycle. The electrode may maintain its charged state for a while, even after the next acquisition cycle starts. In this way an asymmetric electric field is induced in the cell due to a not-perfectly discharged electrode. Needless to say that this type of charging may manifest itself at different individual mantle electrodes with different magnitudes whereby a non-uniform electric field perturbation along the cell axis may emerge.

A different type of electrode charging is surface charging. This usually happens if the metallic surface of the electrode carries a dielectric layer, which (a) can be polarized or charged and (b) cannot easily be discharged due to its lack of conductance. These non-conductive layers usually appear on electrodes due to chemical contamination of the vacuum system. It is known in mass spectrometry that in contaminated vacuum systems or in the presence of outgassing vacuum components nonconductive layers can be deposited on surfaces of electrodes. This way, the actual voltage at the surface of this electrode can differ from the applied voltage. Applied voltages in the range of 1-2 volts can easily be varied due to surface charging by an amount of 20 to 100 mV, although in selected cases larger values can be observed. Experience shows that such dielectric layers can be dynamic. Depending on their chemical composition they can grow or they can get thinner. Their consistency can even change with time, heat and/or applied chemical "stress" (=additional compounds introduced into the vacuum). As a consequence, the ratio of the applied voltage to the actual voltage of the electrode may change with time.

Contaminations of surfaces can also be caused by ions in the cell, but they can also originate from other sources in the vacuum system, external to the ICR cell. Trapped ions can be the source of the contamination within an ICR cell. Repeated ion ejections in the long term can lead to deposition of substances on the inside surface of the mantle electrodes which form a dielectric layer. An uneven distribution of surface contamination on individual longitudinal electrodes can lead to asymmetric surface charging. As a consequence, a radial displacement of the electric field center can have different magnitudes at different points along the cell axis, which in turn leads to a non-uniform electric field perturbation within the cell. Quenching prior to each acquisition cycle cleans the cell from remaining ions for the next acquisition. During a quench pulse a DC voltage of 20-30 volts of opposite polarity to the trapped ions is applied to one of the trapping electrodes, and as a consequence all remaining ions in the cell are attracted to and hit this electrode. Depending on the compounds being measured, the quench event can also produce a dielectric layer on the inside of this trapping plate, which can then, due to surface charging, deteriorate the axial symmetry of the electric field. It depends on the chemical composition of the contaminant layer whether or not a strong bake-out at e.g. 300° C. eliminates it or if it even strengthens the insulation properties of the layer. Bake-out temperatures are often kept lower (around 150° C.) due to material-related reasons. Thus, the layers may not get completely eliminated. Layers of some specific compositions tend to polymerize at higher temperatures and can sometimes only be removed by mechanic scrubbing.

Contamination sources external to the ICR cell are the vacuum components that, for some reason, cannot be kept clean enough. In many cases external heating jackets used for bake-outs first increase the temperature of the walls of the vacuum chamber. The ICR cell is initially cold, and it gets warmer with some delay depending on the heat transfer coefficients of various components used in vacuum. Due to this delay, contaminants can initially thermally desorb off the vacuum chamber walls, can condense at the electrode surfaces of the cold ICR cell and cause surface charging.

SUMMARY OF THE INVENTION

In a first aspect, the invention relates to a method for detecting an asymmetry of an electric field in an FT-ICR cell in a radial direction relative to an axis of the FT-ICR cell, wherein parameters indicative of a position or a diameter of a center axis of a magnetron motion for an ion with a reduced cyclotron frequency $v_R$ in the ICR cell are determined by monitoring relative intensities (relative to the intensity of the main or fundamental peak with frequency $v_R$) of at least one of the ion signals with frequencies of $nv_R$ and $(nv_R \pm mv_M)$, n=2, 4, 6, . . . , and m=1, 2, 3, . . . , as a function of the ion's post capture delay time, and by evaluating maxima and minima of the relative intensities. The ± sign indicates that either a satellite peak shifted to higher frequencies or one shifted to lower frequencies, or also two or more of them simultaneously, can be monitored.

In a second aspect, the invention relates to a method for correcting an asymmetry of an electric field in an FT-ICR cell with mantle electrodes, wherein parameters indicative of a position or a diameter of a center axis of a magnetron motion for an ion with frequency $v_R$ in the ICR cell are determined by monitoring, over several measurements, relative intensities (relative to the intensity of the main or fundamental peak with frequency $v_R$) of at least one of the ion signals with frequencies of $nv_R$ and $(nv_R\ mv_M)$, n=2, 4, 6, . . . , and m=1, 2, 3, . . . , as a function of the ion's post capture delay time, and by evaluating maxima and minima of the relative intensities, and wherein an intensity of a maximum of at least one of an even-numbered harmonics peak for the ion with frequency $v_R$ with frequency $nv_R$ and a satellite peak with a frequency of $(nv_R \pm mv_M)$ is reduced (e.g., minimized) by adjusting compensation voltages at one or more of the mantle electrodes of the FT-ICR cell.

As set out initially, normally the axis of the magnetron motion is expected to coincide with the ICR cell axis, but occasionally the axis of the ionic magnetron orbit in an ion cyclotron resonance cell (ICR cell) shows a radial offset from the geometric axis of the cell. An offset of the magnetron orbit negatively influences the cyclotron excitation process of the ions and their detection. It also impairs the detected signal, leads to an increase of the intensity of the peaks associated with the even-numbered (e.g., second) harmonics in the Fourier transformed spectrum and to more abundant sidebands of the ion signal. In extreme cases, ions can be lost during the cyclotron excitation when they are on large and offset magnetron orbits that are critically close to the cylinder mantle electrodes. Aspects of the present invention describe a method (and a device) for the correction of asymmetric electric fields in an ICR cell that lead to offset magnetron orbits. The method helps identifying a displacement of the electric field axis and/or trimming the correspondingly displaced magnetron axis back to the cell axis.

One intrinsic property of a (fast) Fourier transform detection method is the appearance of harmonic frequencies of the measured (fundamental) mass peaks in a spectrum. In the ideal case of a perfectly symmetric electric field only odd-numbered harmonic frequencies should appear in the spectrum due to a pure cyclotron motion around the center of the ICR cell. The intensities and distribution of the odd-numbered harmonics depend on the ion cyclotron radius and the arrangement of the detection electrodes. Any distortion/ asymmetry of the electric field or improper injection of an ion into the ICR cell, however, entails a magnetron motion of the ions in the ICR cell. In such case, additional even-numbered harmonic frequencies of the main or fundamental ion signal appear in the spectrum.

In various embodiments, an electric field asymmetry in the ICR cell is detected by measuring the intensity of the second harmonic peak with the frequency $2v_R$ of a pseudomolecular ion peak with the reduced cyclotron frequency $v_R$ and a satellite peak with frequency $(2v_R+v_M)$. The intensities of these peaks are reduced (e.g., minimized) by the adjustment of compensation voltages at some of the mantle electrodes. In addition, the starting time of the excitation has to be chosen correctly with regard to the phase of the slow magnetron motion.

In various embodiments, the FT-ICR cell is a dynamically harmonized FT-ICR cell with leaf and inverse leaf electrodes wherein DC voltage values at the inverse leaf electrodes are individually varied for the correction of the electric field asymmetry. In further embodiments, some of the leaf electrodes are split. In some embodiments, the DC voltage values at the inverse leaf electrodes are varied independent of each other until a common minimum of the even-numbered harmonics peak with the frequency of $nv_R$ and its satellite peak with the frequency of $(nv_R \pm mv_M)$ is found. In another embodiment, the relative intensities of the peaks with the measured frequencies of $(nv_R \pm mv_M)$ and $nv_R$ are minimized in dependence of the ion's post capture delay time by changing the independently variable DC voltage values at the inverse leaf electrodes and varying the post capture delay time. In various embodiments, the FT-ICR cell includes excitation and detection electrodes and DC voltage values at the excitation and detection electrodes are individually varied for the correction of the electric field asymmetry. In further embodiments, the FT-ICR cell includes excitation and detection electrodes, and the relative intensities of the peaks with the measured frequencies of $(nv_R\ mv_M)$ and $nv_R$ are optimized in dependence of the post capture delay time for the correction of the electric field asymmetry by changing independently variable DC voltage values at the excitation and detection electrodes of the FT-ICR cell and varying the post capture delay time.

In a third aspect, the invention relates to a dynamically harmonized FT-ICR cell with leaf and inverse leaf electrodes, wherein each inverse leaf electrode is connected to a DC voltage source so that a DC voltage supplied thereto is independently tunable as to provide each inverse leaf electrode with an individual compensation voltage for correcting an asymmetric electric field in the FT-ICR cell.

In various embodiments, each inverse leaf electrode is paired with one adjacent inverse leaf electrode, and wherein each pair is jointly connected to a tunable DC voltage source as to provide each pair of inverse leaf electrodes with an individual joint compensation voltage for correcting an asymmetric electric field in the FT-ICR cell. In further embodiments, the inverse leaf electrodes are segmented longitudinally, each segment being connected to a DC voltage source so that a DC voltage supplied thereto is independently tunable as to provide each segment with an individual compensation voltage for correcting an axially asymmetric electric field, or a non-uniform perturbation of the electric field axis, in the FT-ICR cell. In some embodiments, each segment of an inverse leaf electrode is paired with a corresponding segment of an adjacent inverse leaf electrode and jointly connected to a tunable DC voltage source as to provide each pair of segments with an individual joint compensation voltage for correcting an axially asymmetric electric field in the FT-ICR cell.

In a fourth aspect, the invention relates to an FT-ICR cell with excitation and detection electrodes, wherein each excitation and detection electrode is connected to a DC voltage source so that a DC voltage supplied thereto is independently tunable as to provide each excitation and detection electrode with an individual compensation voltage for correcting an asymmetric electric field in the FT-ICR cell.

In various embodiments, the excitation electrodes are grouped in two or more pairs of adjacent excitation electrodes and the detection electrodes are grouped in two or more pairs of adjacent detection electrodes. In further embodiments, the correction results in that a pattern of compensation voltages applied to at least one of the excitation electrodes and detection electrodes is not homogenous.

In a fifth aspect, the invention relates to an FT-ICR cell with excitation and detection electrodes, further comprising longitudinal correction electrodes positioned between the excitation and detection electrodes, each longitudinal correction electrode being connected to a DC voltage source so that a DC voltage supplied thereto is independently tunable as to provide each longitudinal correction electrode with an individual compensation voltage for correcting an asymmetric electric field in the FT-ICR cell.

In various embodiments, the correction electrodes between the excitation and detection electrodes are segmented longitudinally, each segment being connected to a DC voltage source so that a DC voltage supplied thereto is independently tunable as to provide each segment with an individual compensation voltage for correcting an axially asymmetric electric field, or a non-uniform perturbation of the electric field axis, in the FT-ICR cell. In further embodiments, the correction electrodes have a smaller width than the excitation and detection electrodes.

These and other objects, features and advantages of the present invention will become more apparent in light of the following detailed description of preferred embodiments thereof, as illustrated in the accompanying drawings.

DETAILED DESCRIPTION OF THE INVENTION

In one embodiment, the present invention aims at detecting an electric field asymmetry in the ICR cell and eliminating it by compensating and correcting the electric field.

The existence of the magnetron motion in the cell produces normally very weak sidebands around the main ion cyclotron resonance signal of an ion measured at the frequency $v_R$ which are on the frequency scale in a distance of the magnetron frequency $v_M$ and $2v_M$. Additionally, in the mass spectrum a peak with half the mass, i.e., with the doubled reduced cyclotron frequency ($2v_R$) appears, this is the peak of the second harmonic. Another signal with comparable abundance appears in the direct vicinity of the $2v_R$ signal, which is a satellite peak with a frequency of ($2v_R+v_M$). This satellite peak is separated from the second harmonics by just a magnetron frequency ($v_M$). The mass difference is e.g., at m/z 351 about 0.007 dalton. Depending on conditions, also other satellite signals with even less abundance can appear in distances of $mv_M$ (m=2, 3, 4, . . . ), which are of insignificant abundance under regular measurement conditions, however, can in principle also be used for the electric field correction if sufficiently abundant. In the frequency spectrum or mass spectrum these distances are extremely small, since the magnetron frequency $v_M$ under the applied electric and magnetic field conditions is in general less than 10 Hz.

Figure 1:
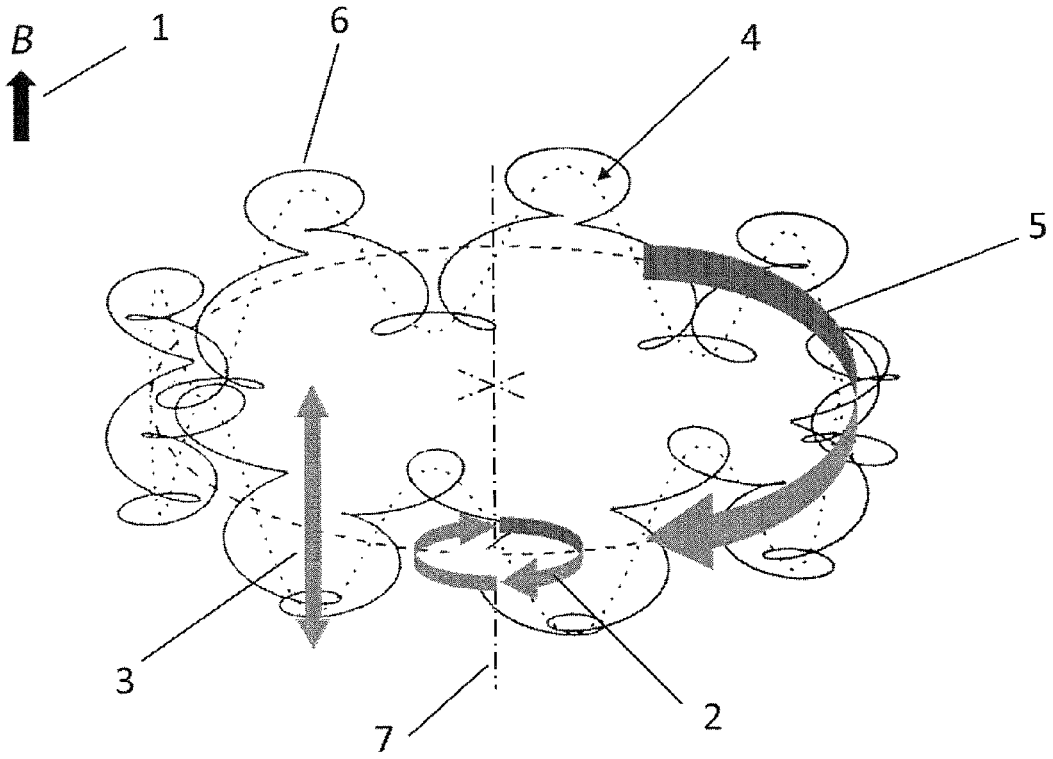
FIG. 1 shows the combined motion of the ions in an ICR cell.
Figure 2A:
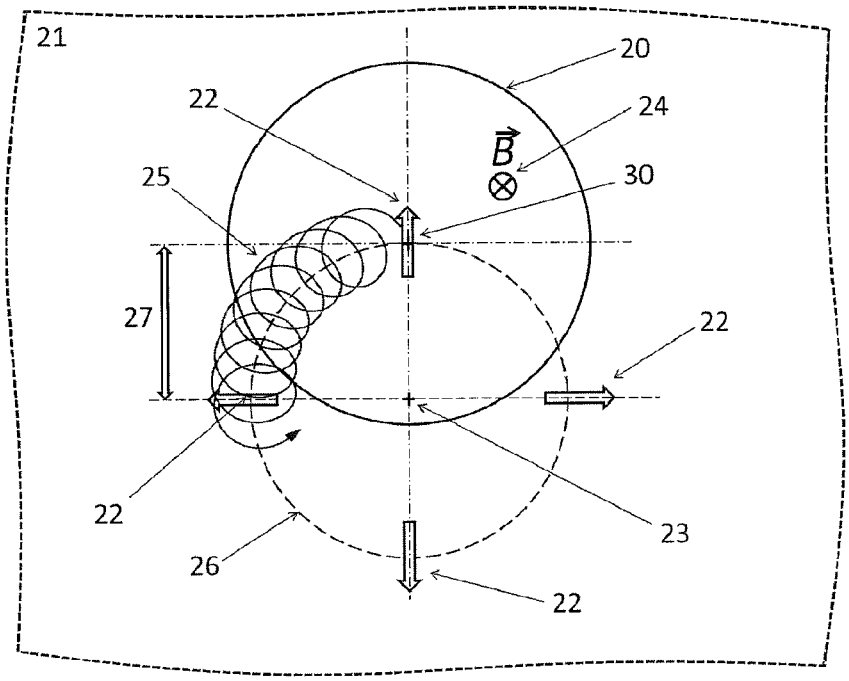
FIG. 2*a* shows the entrance hole within the trapping plate of an ICR cell with a strongly shifted electric field axis. It also shows the ion's starting magnetron orbit when it is introduced into the cell exactly on the cell axis.
Figure 2B:
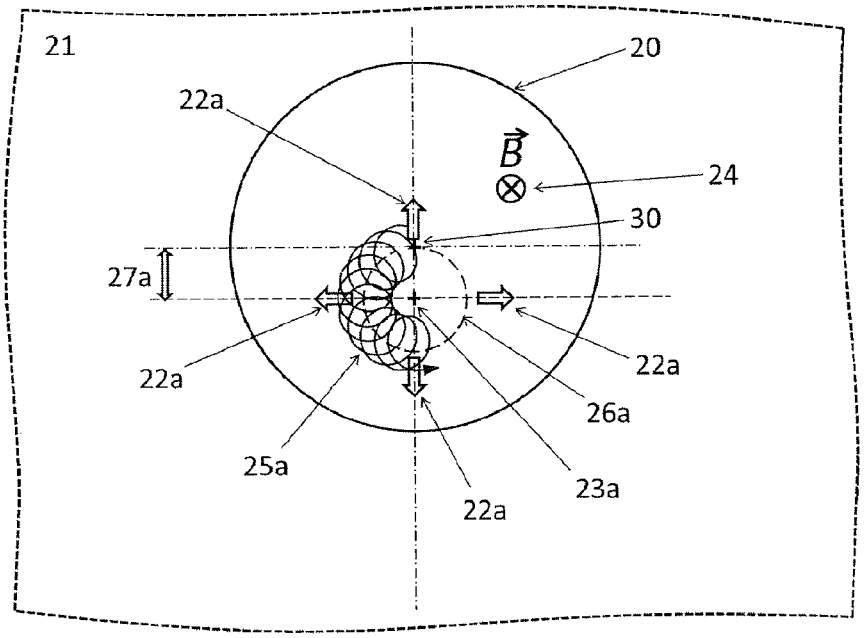
FIG. 2*b* shows the entrance hole of an ICR cell with a slightly shifted electric field axis. It also shows the ion's starting magnetron orbit when it is introduced into the cell exactly on the cell axis.
Figure 3A:
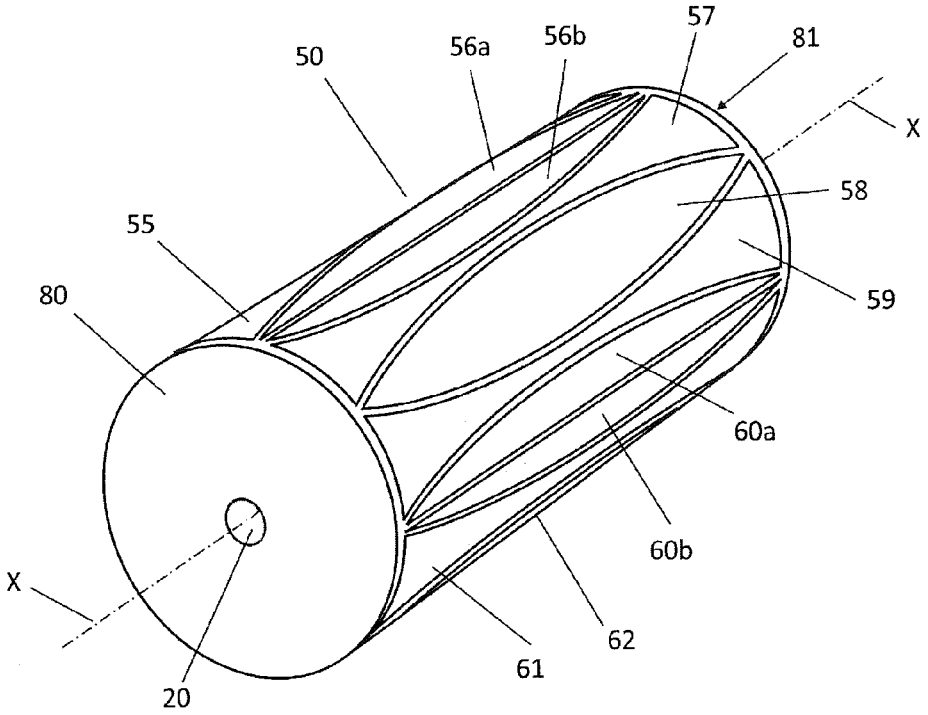
Figure 3a (Prior Art)
FIG. 3*a* (prior art) presents a dynamically harmonized ICR cell with leaf shaped (integral and split) and inverse leaf shaped electrodes.
Figure 3B:
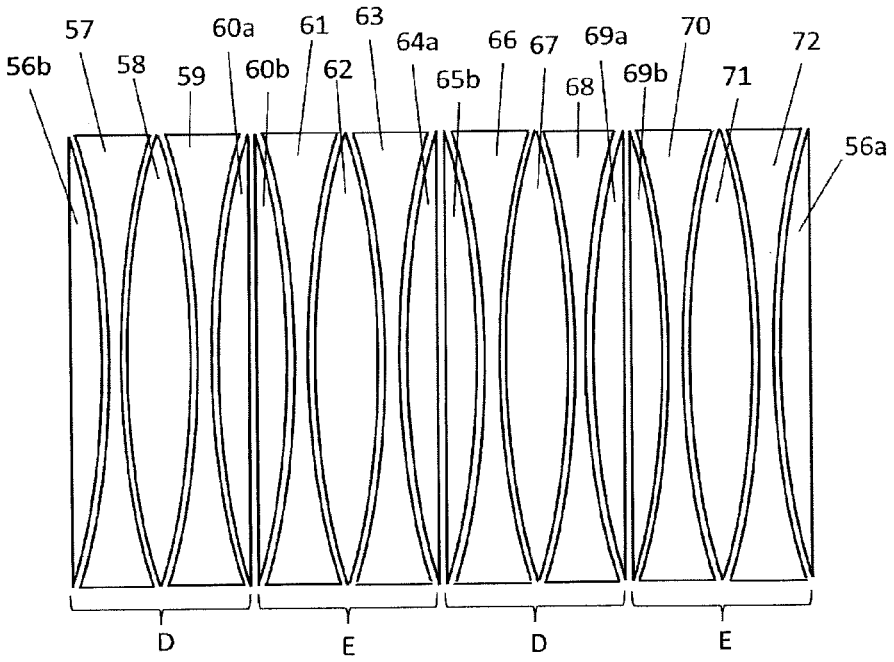
Figure 3b (Prior Art)
FIG. 3*b* (prior art) depicts the unwound mantle electrodes.
Figure 4A:
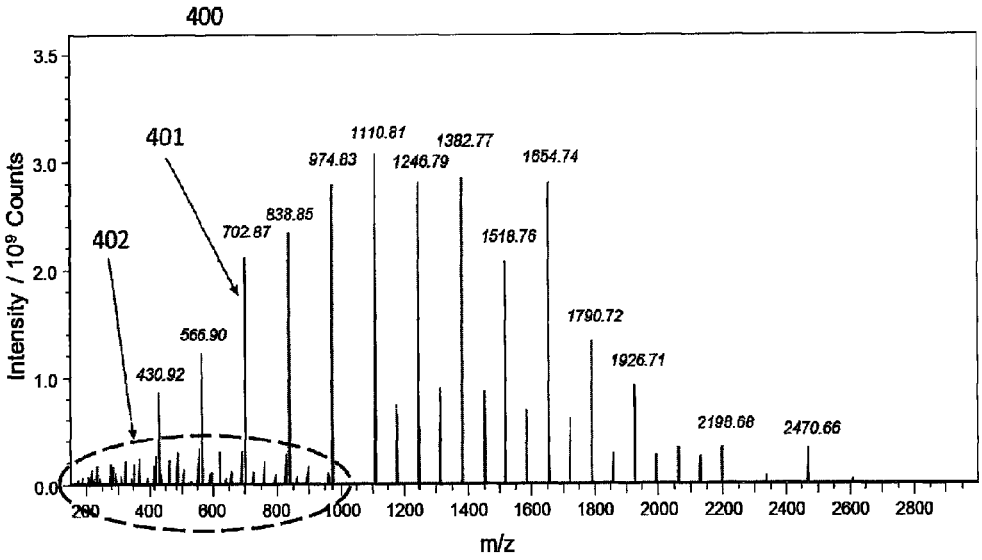
FIG. 4*a* shows a broadband FT-ICR mass spectrum of sodium trifluoroacetate (NaTFA) that mainly includes a series of cluster ion peaks.

In FIGS. 4*a* to 4*d* an example of unfavorable conditions in a dynamically harmonized ICR cell containing leaf and inverse leaf electrodes is shown: An asymmetric electric field is here artificially generated by using a special set of voltages at the four pairs of the leaf electrodes (as shown in FIGS. 3*a*-3*b*). Under these circumstances ions circle on large and offset magnetron orbits. FIG. 4*a* shows the full FT-ICR mass spectrum 400 of sodium trifluoroacetate in the ICR cell with a slightly offset electric field axis and, thus, under unfavorable conditions in terms of position and size of the magnetron orbit to demonstrate the effect.

Figure 4B:
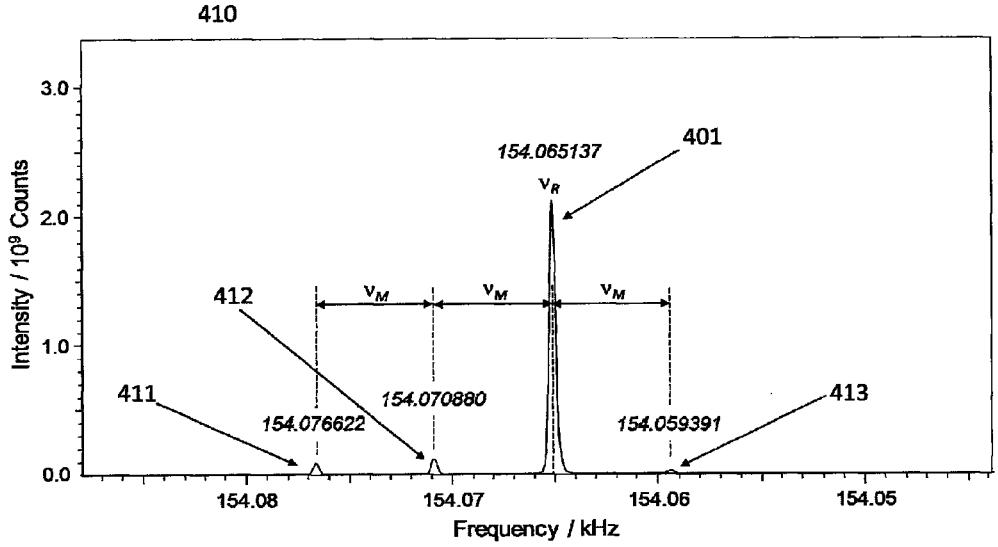
FIG. 4*b* displays a closer view of a selected peak (154.065137 kHz=>m/z 702.87) of the NaTFA spectrum with its sidebands.

The peak with m/z=702.87 Da 401 is selected for a closer view and displayed in FIG. 4*b*. In the abscissa of the spectrum in FIG. 4*b* the scale is converted from mass scale to a frequency scale (therefore the numbers increase to the left) and the peaks are shown with their measured cyclotron frequencies. The reduced cyclotron frequency of the selected main peak with m/z=702.87 Da 401 is called $v_R'$. It has three visibly abundant sidebands at frequencies $v_R'+v_M$ 412, $v_R'+2v_M$ 411, and $v_R-v_M$ 413. Sidebands indicate the existence of significantly large magnetron orbits and confirm the unfavorable conditions in the ICR cell during the acquisition of these spectra.

Figure 4C:
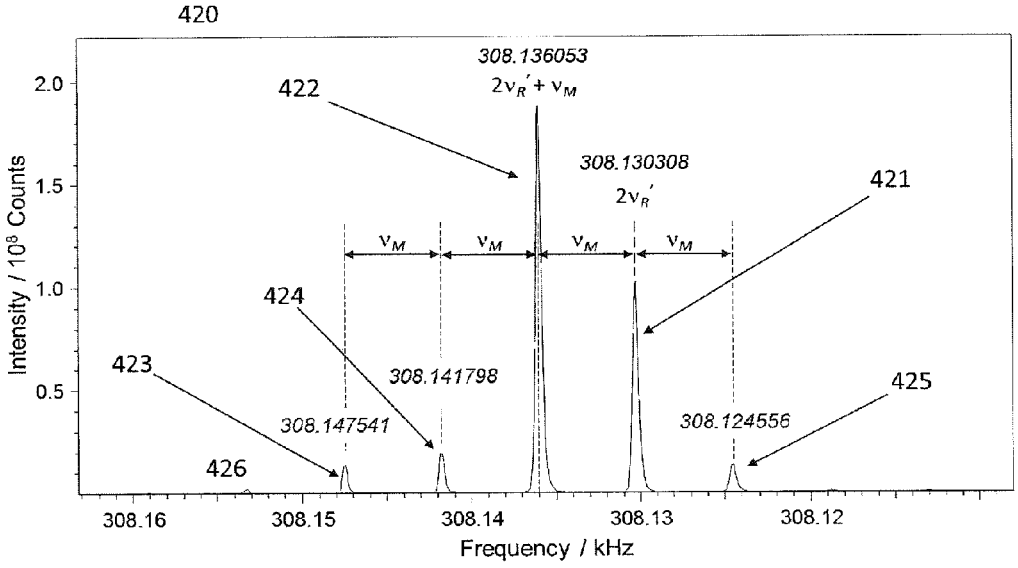
FIG. 4*c* shows a closer view of the second harmonics peak of this ion with the frequency $(2v_R')$, its major satellite peak with the frequency $(2v_R'+v_M)$ and some minor satellite peaks. The FIGS. 4*a*-4*b* show measurements where no correction of an asymmetric electric field in the FT-ICR cell is applied.

FIG. 4*c* shows the second harmonics 421 of the main peak at m/z=702.87 Da (401) at twice its measured cyclotron frequency $2v_R'$, therefore, at the half of its m/z value. The abscissa of the spectrum in FIG. 4*c* is again converted to the frequency scale and all peaks are shown with their measured cyclotron frequencies. The second harmonics has a set of satellite peaks 422, 423, 424 and 425 in distances equal to multiples of the magnetron frequency $v_M$. The satellite peak with highest abundance has the frequency $2v_R+v_M$ 422. In principle, some or all of these satellite peaks 423, 424 and 425 can be used to perform the electric field correction.

The intensity of the second harmonics peak with the frequency of $2v_R'$ is related to the position of the magnetron motion. If the center of the magnetron orbit approaches the cell axis, the intensity of the second harmonics is reduced. If the magnetron axis virtually coincides with the cell axis, the second harmonics peak virtually disappears, that is, is hardly detectable above the noise. Additionally, the intensity of the satellite peak with the frequency $2v_R'+v_M$ is related to the size of the magnetron orbit. If the magnetron radius is large, as in this example, this satellite peak is considerably abundant A comparison of the scales of the ordinates of FIGS. 4*b* and 4*c* shows that the second harmonics and its major satellite peak are by more than an order of magnitude smaller than the main signal. The distribution of the second harmonics peaks 402 can even be seen in the broadband spectrum shown in FIG. 4*a* (see the dashed ellipse).

In an FT-ICR measurement, it is basically advantageous if the magnetron orbit has a relatively small diameter or if it does not exist at all. Unfortunately, experimental methods to reduce the magnetron motion with cooling using a resonant buffer gas are not generally applicable since they are mass selective and require the introduction of relatively high amounts of gas into the ultrahigh vacuum chamber. In addition, it is also desirable that the axis of the magnetron orbit be as close as possible to the axis of the ICR cell. In the best case, it should be coaxial with the cell axis. A compromise would be a small magnetron orbit close to the cell axis. If the electric field in the cell is asymmetric, its axis may be radially displaced against the cell axis. In this case, the magnetron orbit is also shifted and located around this radially displaced electric field axis.

One aim of the electric field correction is that the ions in the cell circle on magnetron orbits that have a diameter as small as possible and are as central as possible. Simulations of the ion motion in the ICR cell show that the second harmonics with the frequency $2v_R$ disappears if the magnetron orbit is concentric with the cell, i.e., if its center is on the cell axis. If the electric field axis does not coincide with the cell axis, i.e., if it is radially displaced, this will also shift the magnetron orbit radially and the second harmonics peak will appear. On the other hand, the intensity of the satellite peak $(2v_R+v_M)$ of the second harmonics increases with the magnetron radius. In order to achieve small magnetron orbits which are as central as possible, in an embodiment according to the present invention it is proposed correcting or compensating electric field conditions by using varying compensation voltages at the various mantle electrodes so that the intensities of the second harmonics and its satellite peak become as small as possible.

Ion motion simulations show, that during the cyclotron excitation process of an ion which is not at the cell axis, the center of the cyclotron motion shifts radially. If, at the start of the cyclotron excitation, the ion is located in the quadrant of an excitation electrode, the center of its cyclotron path is shifted away from the excitation electrode to the axis of the cell. This means the ion will continue orbiting on a slightly smaller magnetron orbit after the cyclotron excitation. The magnetron motion is de-excited or relaxed. If the ion, however, is located, at the start of the cyclotron excitation, in the quadrant of a detection electrode, the center of its cyclotron path is shifted in direction to the detection electrode, away from the axis of the cell. This means, after this cyclotron excitation, the ion continues circling on a larger magnetron orbit. Its magnetron motion is excited during the cyclotron excitation period. An increase of the size (or diameter) of the magnetron orbit leads to a stronger satellite peak $(2v_R+v_M)$ of the second harmonics $(2v_R)$. Thus, in a complete magnetron cycle around the cell axis there are two phases where a cyclotron excitation increases the intensity of the satellite peak $(2v_R+v_M)$ and two phases where a cyclotron excitation decreases the intensity of the satellite peak $(2v_R+v_M)$.

Figure 5A:
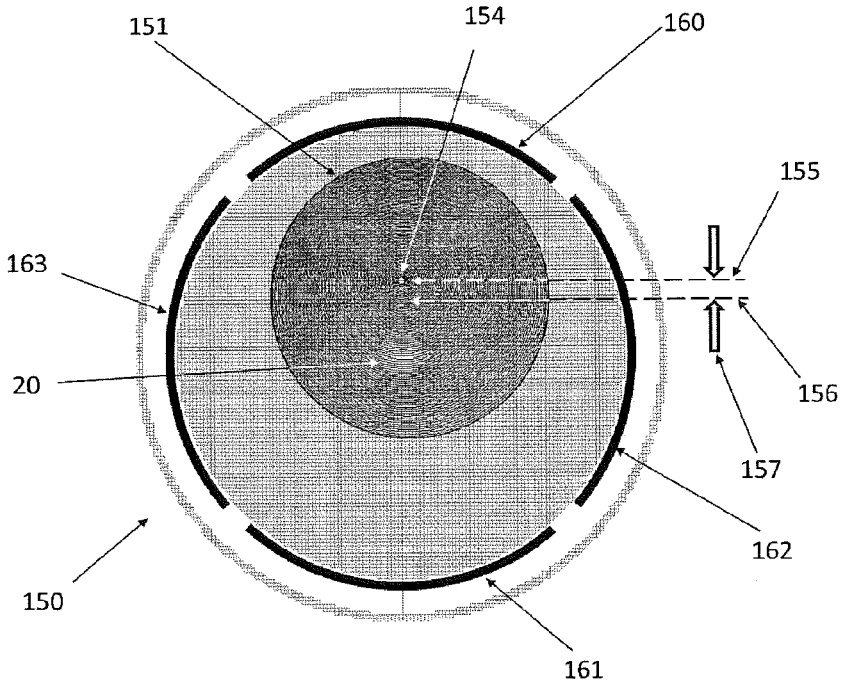
FIG. 5*a* shows, in a cross sectional view of an ICR cell, the simulated cyclotron excitation of an off axis ion in the quadrant of an excitation electrode.

FIG. 5*a* shows the result of a simulation. In the cross sectional view 150 of a cylindrical ICR cell with excitation electrodes 160 and 161 and detection electrodes 162 and 163, a simulated cyclotron path 151 is depicted. Prior to its cyclotron excitation, the ion is not on axis of the ICR cell, but on a position 154 in the quadrant of one of the excitation electrodes 160 due to its large and excited, or offset, magnetron orbit. After the cyclotron excitation the center of the excited cyclotron orbit is no longer at the same position 154 but it is now somewhat closer to the center of the cell. The difference 157 is shown between the two dashed lines 155 and 156 in FIG. 5*a*.

Figure 5B:
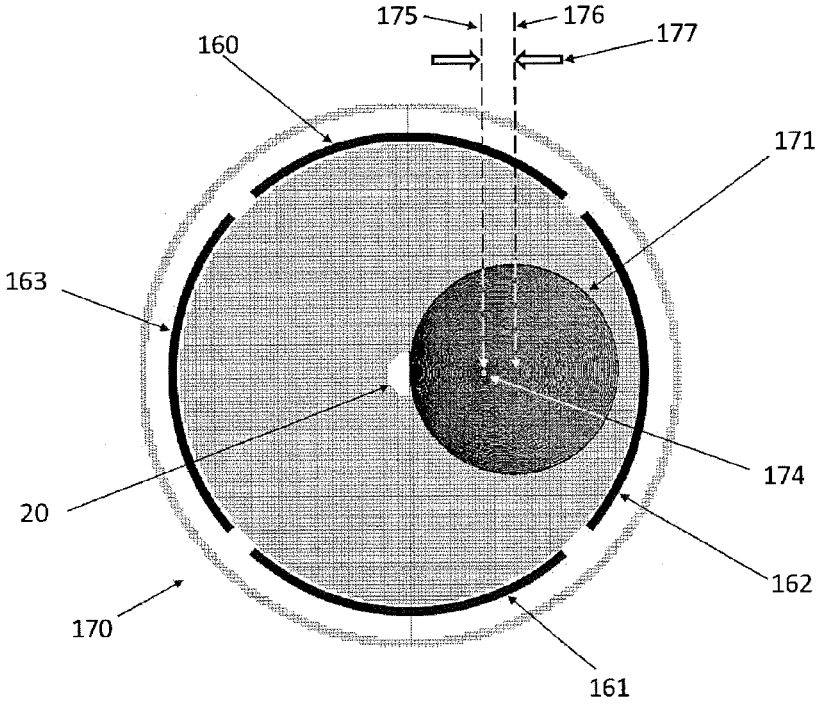
FIG. 5*b* shows, in the same cross sectional view of the ICR cell, the simulated cyclotron excitation of an off axis ion in the quadrant of a detection electrode.

FIG. 5*b* also shows the result of a simulation. In the cross section view 170 of a cylindrical ICR cell with excitation electrodes 160 and 161 and detection electrodes 162 and 163 a simulated cyclotron path 171 is depicted. Prior to its cyclotron excitation, the ion is not on axis of the ICR cell, but at a position 174 in the quadrant of one of the detection electrodes 162 due to its large and excited, or offset, magnetron orbit. After the cyclotron excitation, the center of the excited cyclotron orbit is no longer at the same position 174 but it is now somewhat closer to the detection electrode 162. The difference 177 is shown between the two dashed lines 175 and 176 in FIG. 5*b*.

Compared to the cyclotron motion, the magnetron motion is very slow. Thus, when an ion is cyclotron-excited on its magnetron orbit, after the excitation, the ion practically does not move further on its magnetron path. If between the capture of the ion in the cell and the excitation of the cyclotron motion a variable delay (post capture delay, PCD) is inserted into the experiment sequence, the ion can be monitored on its magnetron orbit with the satellite peak $(nv_R+mv_M)$ of an even-numbered harmonics, such as the second harmonic with n=2. If after a certain post capture delay time the ion arrives in the quadrant of a detection electrode, where the resonant cyclotron excitation takes place, the monitored intensity of the $(2v_R+v_M)$ peak increases to a maximum. After a still larger post capture delay time the ion arrives in the quadrant of an excitation electrode when the resonant cyclotron excitation takes place, and the monitored intensity of the $(2v_R+v_M)$ peak decreases, for example to a minimum.

The measured dependence of the relative intensity of the $(2v_R+v_M)$ peaks on the post capture delay (PCD) can be used to obtain information about the displacement (or shift) of the magnetron orbit and about the symmetry of the DC electric field in the cell. PCD diagrams of ions on magnetron orbits around the cell axis show two equally high maxima and two equally high minima within one magnetron period. If the maxima are not equally high, this is a sign that the magnetron orbit is shifted, i.e., that the electric field axis no longer coincides with the cell axis. Relatively small magnetron orbits result in flat and shallow PCD curves with low intensity. Larger magnetron orbits are responsible for the higher maxima and deeper minima Magnetron orbits which are shifted completely to one side of the cell result in PCD curves with one single maximum and one single minimum within a magnetron period. Small magnetron orbits which are completely off axis and shifted to a quadrant of the cell, which however, due to their small size still are very close to the cell axis, form flat PCD curves with a single maximum and a single minimum within a magnetron period and still deliver good FT-ICR spectra. It has to be noted that the relative intensity of the $(2v_R+v_M)$ peak changes often very strongly with the variation of the post capture delay, while the relative intensity of the second harmonics $(2v_R)$ shows no significant change vs. the variation of the post capture delay time.

Figure 6:
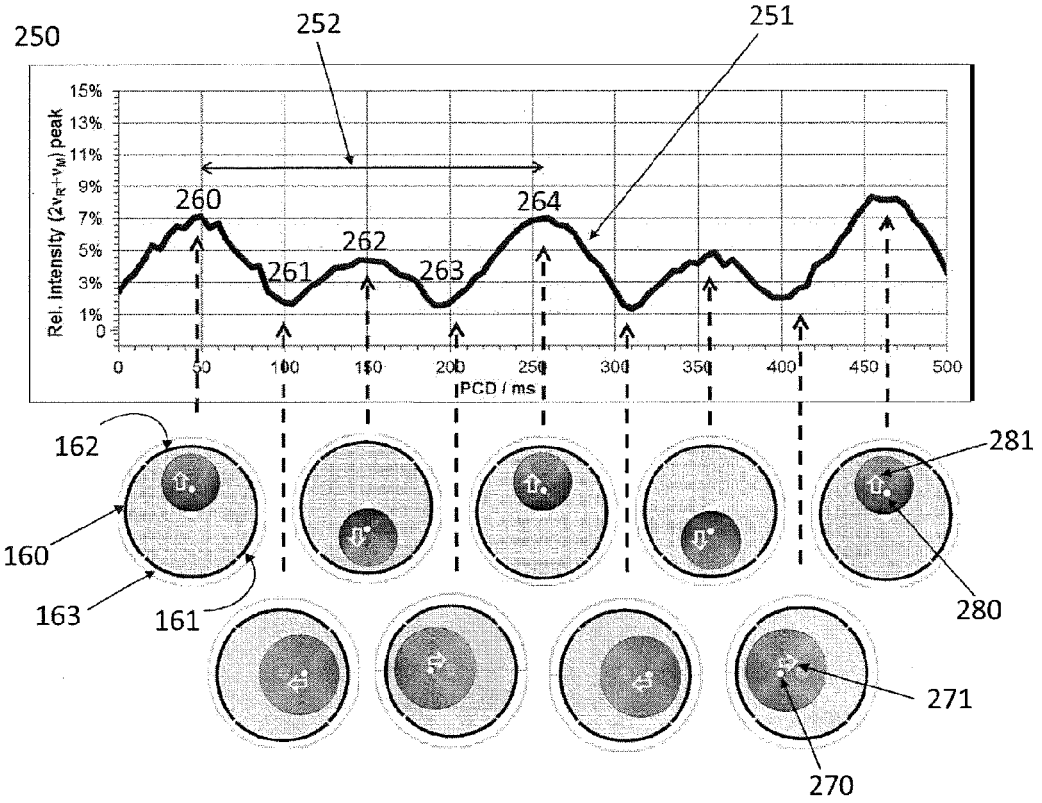
FIG. 6 depicts a post capture delay (PCD) curve with maxima and minima, the reference numbers of which are explained in the text further below, and with corresponding phases of the motion of the ions.

FIG. 6 shows a PCD diagram 250 in which the change of the relative intensity of the peak with the measured frequency $(2v_R+v_M)$ is plotted as a function of the post capture delay time of the ions in the cell. As described above the PCD curve 251 shows maxima 260, 262, 264 and minima 261, 263. The distance between a first maximum 260 and a third maximum 262 corresponds to the period 252 of the magnetron motion, which is in this case about 200 ms. This in turn corresponds to a magnetron frequency of about 5 Hz. In the lower half of the figure the corresponding positions of an ion in the cell are shown, at which the cyclotron excitation took place. Here, the excitation electrodes 160 and 161 and the detection electrodes 162 and 163 can be seen in the cross sectional views of ICR cells. In these simulated pictures, ions start the cyclotron excitation always at an ion position which is not on the cell axis. Starting positions of the ion cyclotron excitations are marked as white dots 270, 280 and the shift direction of the center of the cyclotron orbit during the excitation process is shown by white arrows 271, 281. As described above, this shift is in direction 281 to a detection electrode 162 if the excitation process takes place near a detection electrode 162.

This in turn means an excitation of the magnetron motion during the cyclotron excitation. However, if a cyclotron excitation is in the quadrant of an excitation electrode 160, the center of the cyclotron path is shifted away from the excitation electrode 160, in direction 271 to the cell center. This in turn means a de-excitation or a relaxation of the magnetron motion during the cyclotron excitation.

If the axis of the DC field coincides with the ICR cell axis the cyclotron motion winds as a magnetron orbit on a circle around the cell axis. In this case, the maxima in the PCD curve should be equally high. However, in FIG. 6 the maxima in the PCD curve 251 are not equally high. They are alternatingly higher and lower. This means that the magnetron does not circle around the cell axis since the electric field axis is shifted. By compensating the shifted electric field, the field axis can be moved back close to the geometric axis of the cell, in the best case even such that it coincides with the geometric axis.

Figure 7:
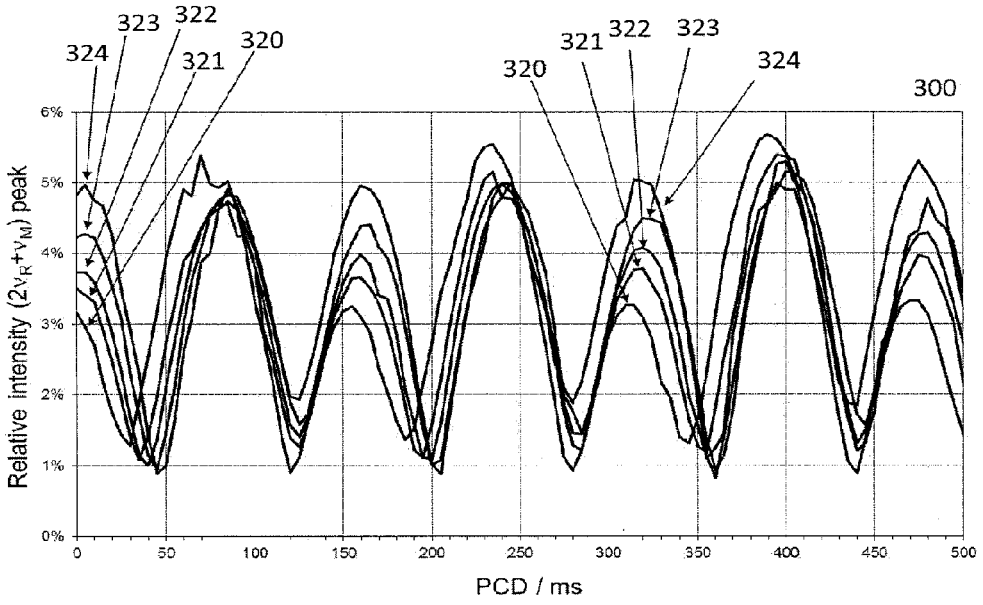
FIG. 7 depicts five post capture delay curves showing an electric field axis correction by varying the voltage of one pair of inverse leaf electrodes in a dynamically harmonized ICR cell.

In one embodiment, for correcting an asymmetric electric field inside a dynamically harmonized ICR cell, the inverse leaf electrodes are used, which anyway carry a common DC potential. This DC potential can be re-adjusted in order to shim the shifted field axis back to the geometric axis of the cell. FIG. 7 shows the effect of the electric field correction in a dynamically harmonized ICR cell (50) from FIG. 3*a* on a different PCD diagram (300). The first PCD curve (320) shows alternating low and high maxima. Prior to plotting this curve in a dynamically harmonized ICR cell, a DC voltage of 1500 mV is connected to all inverse leaf-shaped electrodes of the cylinder mantle. For the electric correction, the voltage applied to a pair of the inverse leaf electrodes in the excitation (61 and 63 in FIG. 3*b*) is varied, while the others are kept at 1500 mV. Before plotting the curve 321 the voltage of the electrode pair 61 and 63 is reduced to 1485 mV. Upon this change the lower maxima become slightly higher. The curves 322 and 323 are plotted with voltages of this electrode pair at 1475 mV and at 1465 mV, respectively. Finally, at 1450 mV a PCD curve 324 is observed, which contains approximately equally high maxima. The field compensation is accomplished and the axis of the magnetron orbit is now close to concentric with the cell axis.

Figure 8:
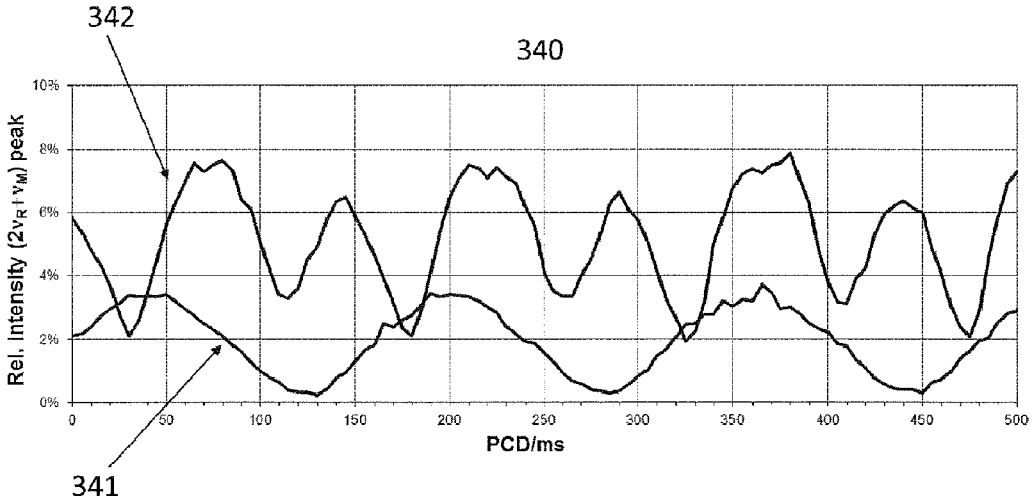
FIG. 8 shows a PCD curve having a single maximum within a magnetron period in comparison to another PCD curve having double maxima within a magnetron period.

As mentioned above, a PCD curve with all equally sized maxima is a sign for a central magnetron motion, i.e., a practically central electric field axis. However, it can also be desirable that the magnetron orbit has a relatively small radius. Thus, the intensity of the satellite peak with frequency for example $(2v_R+v_M)$ needs to be as small as possible, which in turn means the intensity of the PCD curve must be as small as possible. Experience shows that PCD curves which remain within an intensity range of a few percent, such as up to 2-3% or even more, are a sign for an acceptable field correction state of the ICR cell. Even a small magnetron orbit which is a little shifted away from the cell axis, and is completely in the quadrant of e.g., a detection electrode so that it produces a PCD curve with a single maximum within a magnetron period, is also an acceptable compromise. FIG. 8 shows a PCD diagram 340 with the curve 341, which shows only one maximum and one minimum within a magnetron period after a field correction is applied. In the same figure, as a comparison, another PCD curve 342 is shown which contains, after a different compensation voltage adjustment, two maxima and two minima within a magnetron period.

FIGS. 9*a* to 9*d* show the effect of the field correction on the FT-ICR spectrum in a dynamically harmonized ICR cell. The spectrum 410 with the selected peak 401 before the application of the field correction is known from FIG. 4*b*. As mentioned above, this spectrum is shown to illustrate the effects under unfavorable electric field conditions in the ICR cell. The sidebands 411, 412, and 413 are an indication of a significantly large magnetron orbit.

Figure 9A:
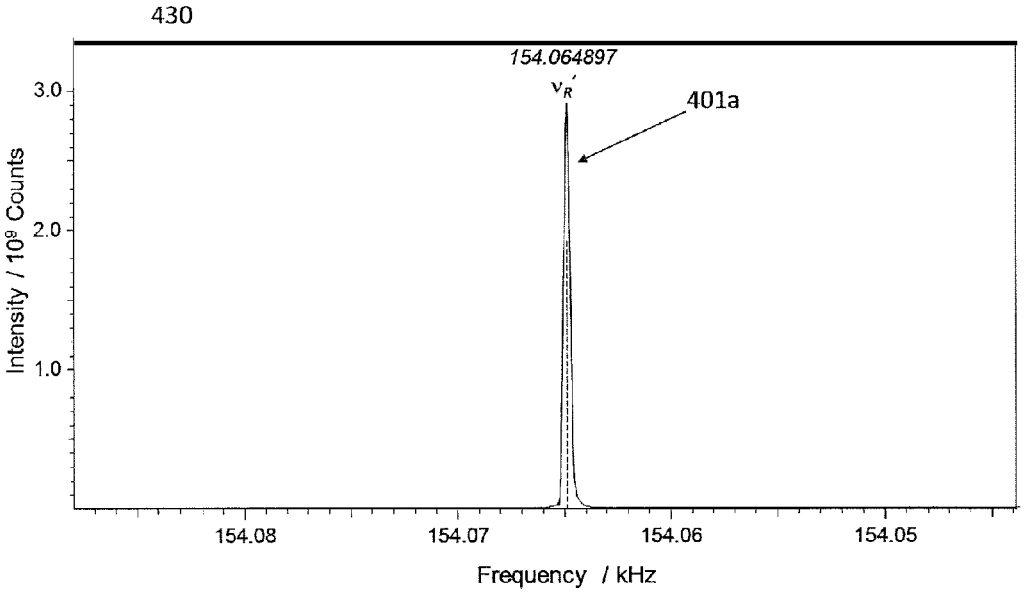
FIG. 9*a* shows the selected peak (154.064897 kHz=>m/z 702.87) from NaTFA spectrum, which was already displayed in FIG. 4*b*, after the electric field correction in the FT-ICR cell.
Figure 9B:
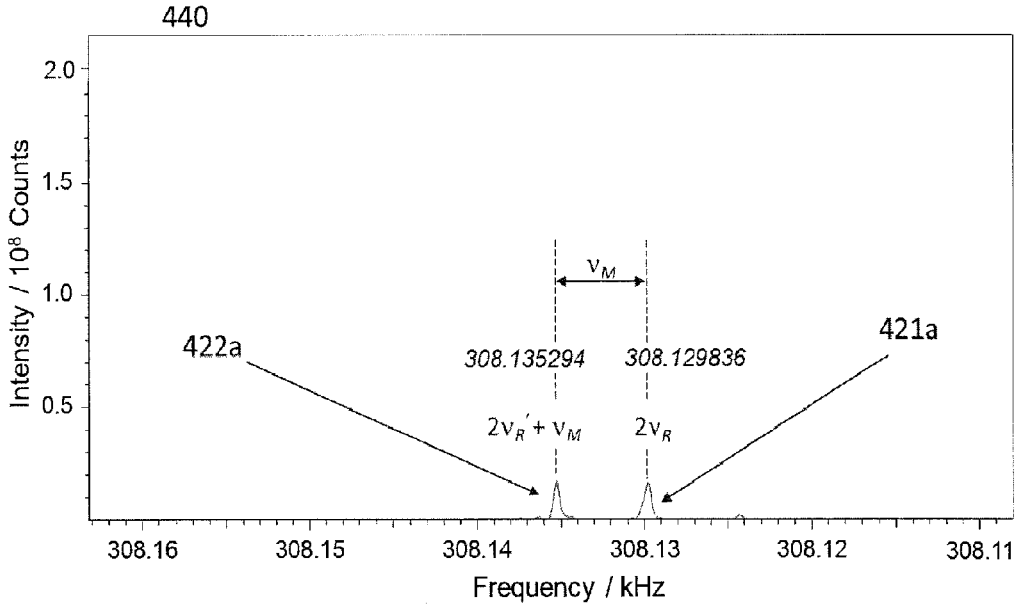
FIG. 9*b* shows the second harmonics peak of this selected ion and its satellites (on a frequency scale) after the field correction, FIG. 9*c* displays the full NaTFA FT-ICR mass spectrum after the field correction.

FIG. 9*a* shows the same part of the FT-ICR spectrum 430 after the application of a field correction according to an embodiment of the invention. Voltage differences applied to the inverse leaf electrodes for correction were −10 mV at the electrode pair 57 and 59, −100 mV at electrode pair 61 and 63, +10 mV at the electrode pair 66 and 68, and +100 mV at the electrode pair 70 and 72 (numerals as in FIG. 3*b*). The only visible peak in the spectrum after this correction is the main peak with the frequency $v_R'$ 401*a*, the sidebands are no longer visible. Furthermore, the absolute intensity of the main peak $v_R'$ 401*a* is here larger than before the correction 401; FIG. 4*b*. With the reduced magnetron radius, possible ion losses during cyclotron excitations are avoided. FIG. 4*c* depicts a spectrum 420 of the second harmonics $2v_R'$ 421 and its satellite peaks 422, 423, 424 and 425 before field correction. FIG. 9*b*, on the other hand, depicts a spectrum 440 after field correction. There are only two peaks left, the second harmonics 421*a* now less than a fifth of 421 in FIG. 4*c*, and the largest satellite peak 422*a*, now about 10% of the corresponding peak 422 in FIG. 4*c*.

Figure 9C:
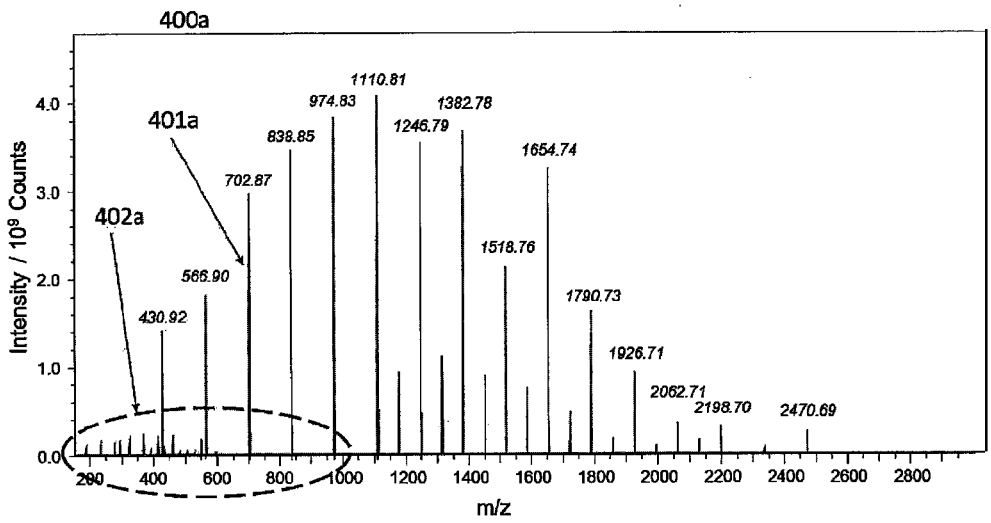
FIG. 9*d* depicts the second harmonics and its satellites at three states: Before field correction, at a point with symmetric inverse leaf voltages and finally after the full correction.

FIG. 9*c* shows the full FT-ICR mass spectrum 400*a* of NaTFA after the field correction. Not only is the intensity of the selected peak 401 increased, but also all other peaks are more abundant after the field correction. The intensity of the second harmonics peaks group 402 below m/z 1,000 is also reduced 402*a* (dashed ellipse) in the field-corrected spectrum 400*a*.

Figure 9D:
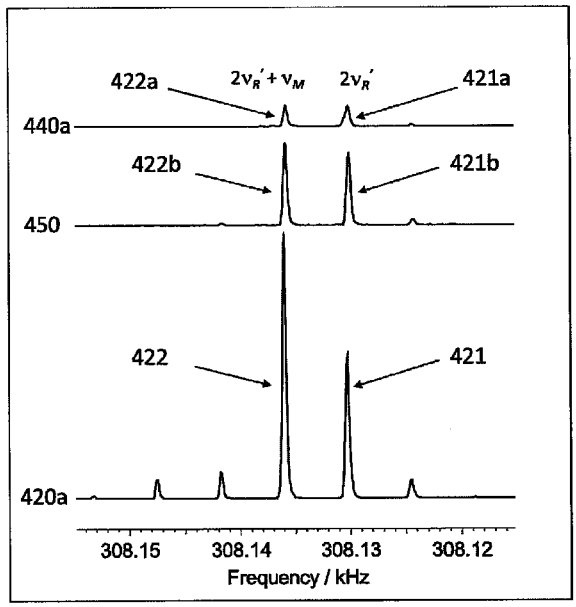

FIG. 9*d* summarizes the changes at the second harmonics peak and its satellites during the field correction on the same intensity scale. The extracted partial spectrum 420*a* at the bottom shows the second harmonics 421 of the ion with m/z 702.87 Da (on a frequency scale) and its major satellite peak 422 in artificially generated asymmetric field conditions. The partial spectrum 450 in the middle shows the situation during the field correction when the voltages of all inverse leaf electrodes are exactly the same (+1.5V), i.e., a perfectly symmetric voltage case. The intensities of the second harmonics 421*b* and its satellite 422*b* are already much less. The top spectrum 440*a* shows the two peaks when the field correction is accomplished. The second harmonics 421*a* and its satellite 422*a* are significantly smaller than in the starting spectrum 420*a*.

An interesting point here is that after the accomplished field correction and minimizing the second harmonics and its satellite peak, the final voltage setting is not symmetric either. However, they are differently asymmetric than the initial setting. In other words, the pattern of compensation voltages is not homogeneous over the set of different electrodes.

The unfavorable starting conditions (FIG. 4*b, c*) were due to an artificial asymmetric voltage setting in the cell. These initial voltage values before field correction were: 1.50V at the electrode pair 57 and 59, 1.55V at the electrode pair 61 and 63, 1.50V at the electrode pair 66 and 68, and 1.45V at the electrode pair 70 and 72 (numerals as in FIG. 3*b*). The final voltage values after field correction were: 1.49V at the electrode pair 57 and 59, 1.45V at the electrode pair 61 and 63, 1.51V at the electrode pair 66 and 68, and 1.55V at the electrode pair 70 and 72. Since this setting is providing the smallest second harmonics $(2v_R')$, smallest satellite peak $(2v_R'+v_M)$ and the smallest sidebands of the main peak, it is obviously the preferred way for forming a symmetric electric field when the axis coincides (or nearly coincides) with the cell axis.

The experience shows that the correction voltages usually deviate from the previous uncorrected voltage settings between about ±10 and 100 mV, but can also be higher or lower in individual cases.

Observations also show that the amplitude of the irradiated RF electric field for the excitation of the ion cyclotron motion also influences the shape of the PCD curves. PCD curves with equally high maxima within a magnetron period can start showing low and high maxima if the excitation amplitude is changed, e.g., doubled. Therefore, it is advantageous to perform field correction processes at the excitation amplitudes which will be used in an actual experiment series.

Figure 10A:
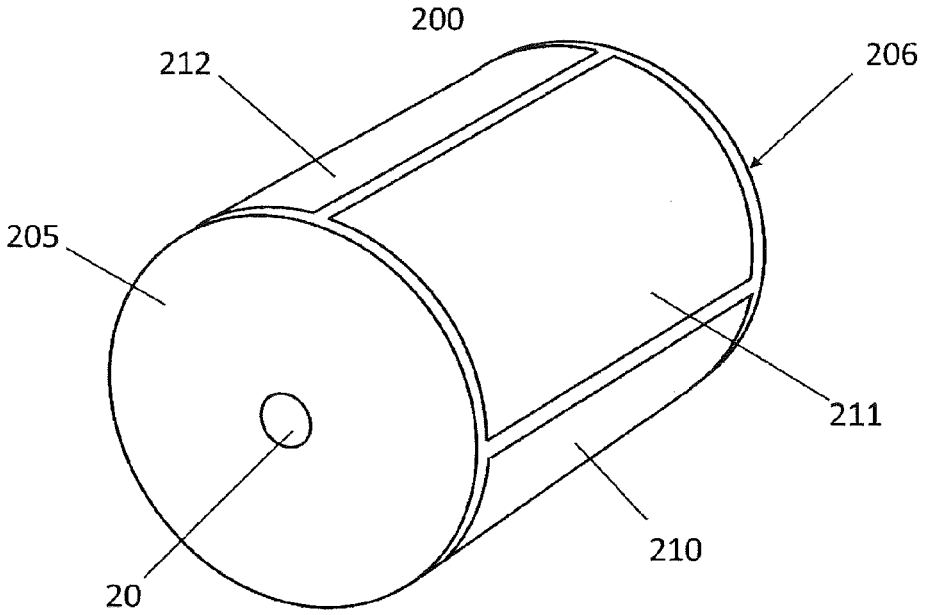
Figure 10a (Prior Art)
FIG. 10*a* (prior art) shows a conventional cylindrical FT-ICR cell with two excitation and two detection and two end electrodes for axial trapping.

A shift of the electric field axis is not only observed in dynamically harmonized ICR-cells. Also conventional cylindrical ICR-cells, as shown at (200) in FIG. 10*a*, can have a shifted electric field axis. An asymmetrically contaminated trapping electrode in a classical ICR cell, for instance, can cause a slightly asymmetric electric field. Since in conventional ICR cells no extra longitudinal electrodes exist to which DC voltages are connected, the correction or compensation of the asymmetry is different here. In these cells, according to further embodiments of the invention, the electric field correction can be performed by connecting variable voltages to the excitation electrodes (one of them visible, 211) and to the detection electrodes 210 and 212. Detection electrodes are usually sensitive and often generate a noisy signal if a DC voltage is applied to them. However, if a battery is used as power source, for example, the noise can be reduced (e.g., minimized) also in this case due its very stable output.

Figure 10B:
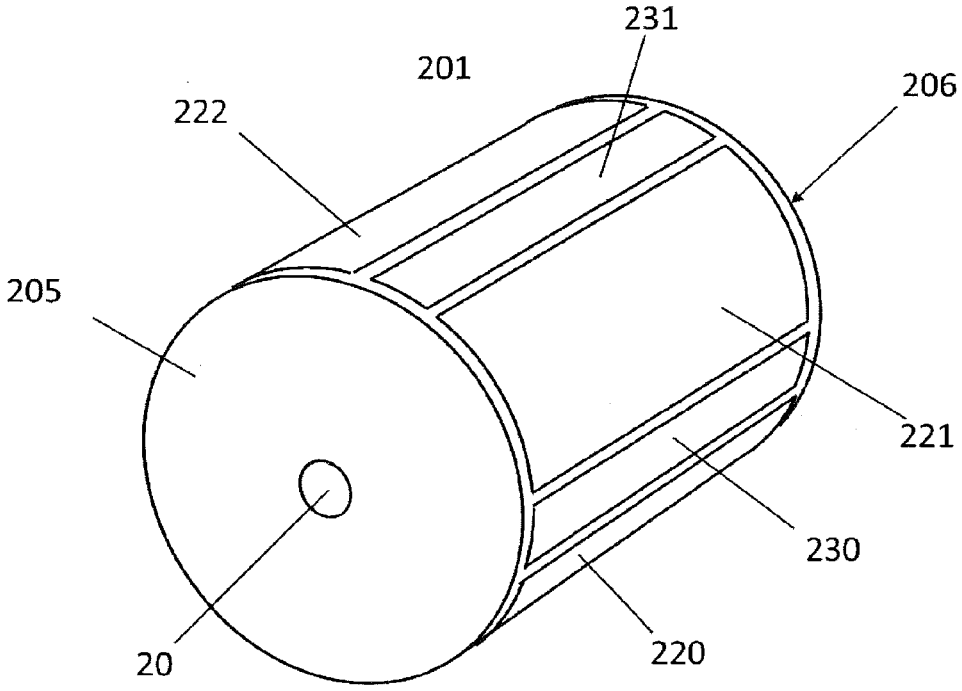
FIG. 10*b* depicts a cylindrical cell in which between each excitation and detection electrode of the cylinder mantle a correction electrode is placed.

Another alternative embodiment according to the invention would be to modify a conventional cylindrical ICR cell with additional electrodes that carry the necessary DC voltage for an electric field axis correction. Since most of the voltages used for a successful correction are less than 100 mV, a disturbance of the ICR cell operation would be relatively minimal. The embodiment in FIG. 10*b* shows such a cylindrical cell 201 with a total of four longitudinal correction electrodes e.g., 230 and 231 between excitation electrodes (one of them visible, 221) and detection electrodes 220 and 222. Four longitudinal correction electrodes, in this case symmetrically arranged about the cell axis at 90° intervals, can basically move the electric field axis back to the geometric cell axis if the field axis was uniformly shifted in a radial direction. Uniform means here that the general form of the electric field is conserved. It is just shifted in the radial direction but the electric field axis remains essentially parallel to the geometric axis. In this simplest case, the field axis is not bent, rippled or tilted.

In some cases FT-ICR cells with a larger number of excitation and/or detection electrodes are used. Using multiple pairs of detection electrodes helps acquiring higher resolution FT-ICR spectra. In the cells for these applications also a larger number of correction electrodes can be used. In an FT-ICR cell with four excitation and four detection electrodes, also eight correction electrodes can be placed between each of these FT-ICR mantle (excite and detect) electrodes. Even if the cell is not used for higher frequency detection, excitation and detection electrodes can still be divided longitudinally into two or more parts and a thin longitudinal correction electrode can be placed between each of them.

Figure 10C:
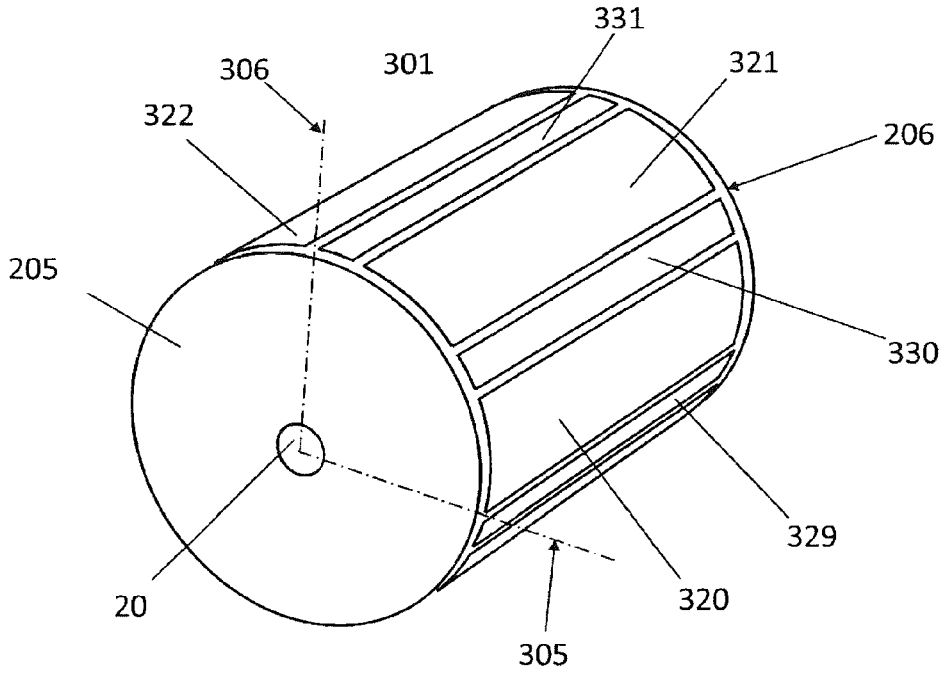
FIG. 10*c* shows a modified cell containing two pairs of excitation electrodes and two pairs of detection electrodes in which between each individual cylinder mantle electrode a correction electrode is placed.

FIG. 10*c* shows as example a cell 301 with eight FT-ICR mantle electrodes with longitudinal correction electrodes (total of 8) placed between each of them. In this figure in a 90° angle between the dashed-dotted lines 305 and 306 an excitation electrode 320, a correction electrode 330, a detection electrode 321, and a second correction electrode 331 are fitted. The electrode 322 is another excitation, and 319 another detection electrode while 329 is again a correction electrode. Element 205 and 206 are the axial trapping electrodes of the ICR cell.

Unfortunately, sometimes electric field disturbances in the ICR cell appear which are more complicated than just a simple linear shift of the field axis. The reason may be a more complex distribution of the electrode surface charging which not only shows a radial non-uniformity but also an axial one. In this non-linear case a linear axis correction, e.g., using the inverse leaf electrodes 61 and 63 of a dynamically harmonized cell 50 as shown in FIG. 3*b*, cannot be successful, as these longitudinal electrodes are parallel to the cell axis. Using these electrodes only a radial field correction can be made, but not an axial one.

Figure 11:
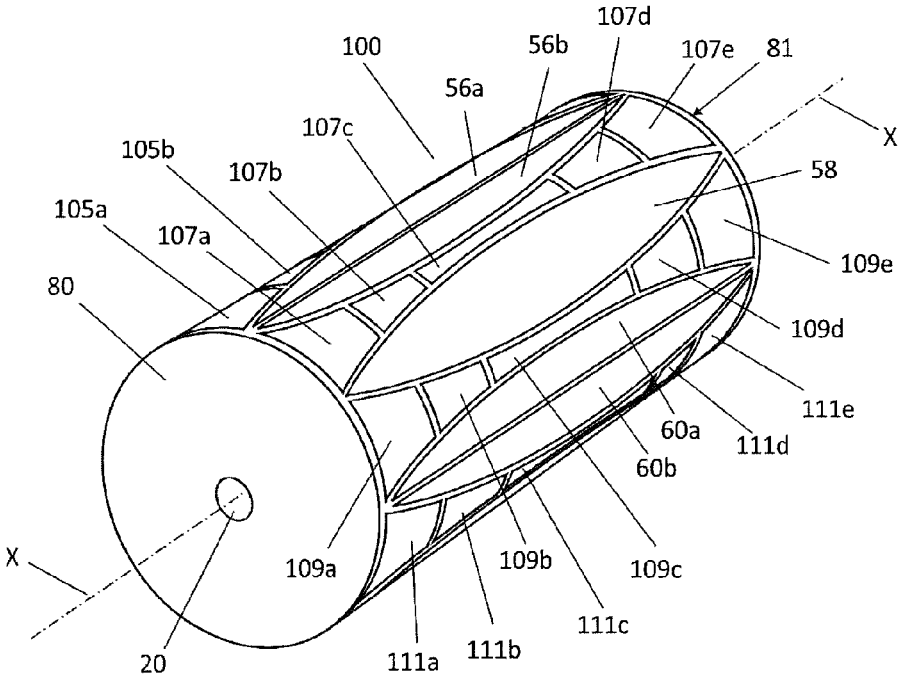
FIG. 11 depicts a dynamically harmonized ICR cell modified according to an embodiment of the present invention by longitudinally dividing each inverse leaf electrode into five segments in order to be able to also correct axial components of the electric field disturbances.

In order to also correct field errors with axial components, the use of segmented (correction) electrodes in the ICR cell is suggested. Segmented electrodes can also be used to correct the electric field, if the field axis is perturbed non-uniformly, such as by bending, rippling or tilting. A bent, rippled or tilted electric field axis is formed, for instance, if at different axial positions the center of the electric field is radially shifted by different amounts. In a dynamically harmonized cell 50 as shown in FIGS. 3*a*-3*b* the inverse leaf shaped electrodes (e.g., 57) can be segmented. FIG. 11 shows, according to another embodiment of the invention, a modified dynamically harmonized cell 100 in which the inverse leaf shaped cylinder mantle electrodes are divided. Divided inverse leaf electrodes visible in this figure have the partial electrodes 107*a*, 107*b*, 107*c*, 107*d*, 107*e*, and 109*a*, 109*b*, 109*c*, 109*d*, and 109*e*, as well as 111*a*, 111*b*, 111*c*, 111*d*, 111*e*. Only two partial electrodes 105*a* and 105*b* are visible from a further inverse leaf electrode family 105*a*-105*e*. Each of these partial electrodes is supplied with an independent and variable DC voltage. The configuration depicted in FIG. 11 is one of the possible embodiments and contains inverse leaf electrodes divided in five parts. Inverse leaf electrodes including more parts can be made. In this configuration leaf electrodes (e.g., 58) as well as the half-leaf electrodes (e.g., 56*a* and 56*b*) remained unchanged as in the original version of the dynamically harmonized cell 50 illustrated in FIG. 3*a*.

Figure 12:
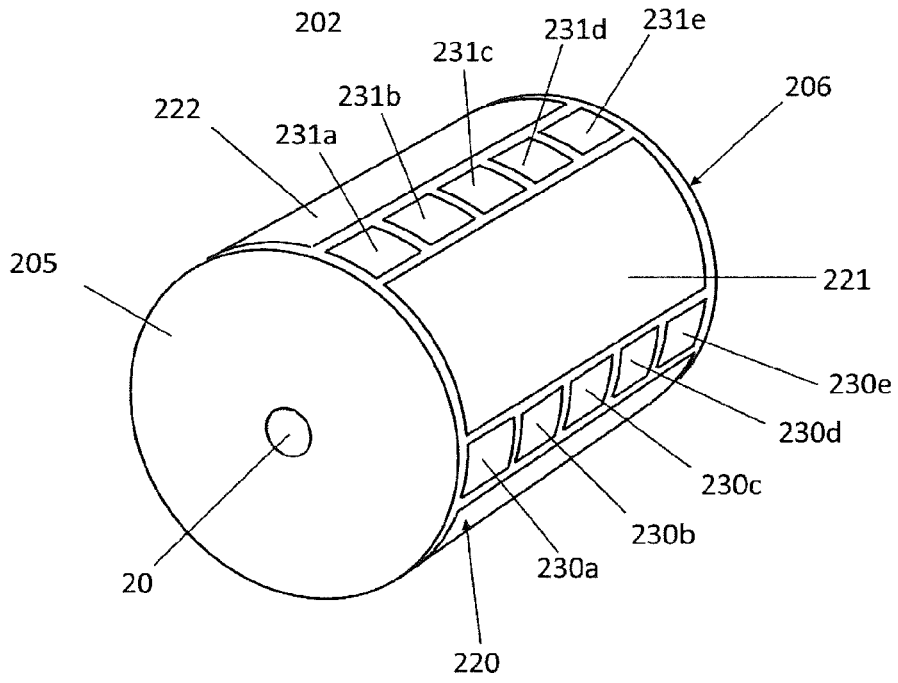
FIG. 12 shows a modified cylindrical cell according to an embodiment of the present invention in which correction electrodes between the excitation and detection electrodes are longitudinally divided each into five segments in order to be able to also correct axial components of the electric field disturbances.

In order to correct non-linear field distortions in a modified cylindrical ICR cell 201 as shown in FIG. 10*b* this can be further modified by dividing the correction electrodes 230 and 231. Such a further modified cell 202 is shown in FIG. 12 as another embodiment according to the invention. Axial distortion components of an asymmetric electric field can be compensated using these correction electrodes which are in this particular embodiment divided into five segments 230*a*, 230*b*, 230*c*, 230*d*, 230*e*, and 231*a*, 231*b*, 231*c*, 231*d*, 231*e*. To each segment of the divided correction electrodes an independently variable DC voltage is connected. The number of electrode segments is not limited to the number five as in this embodiment but can be varied.

Figure 13:
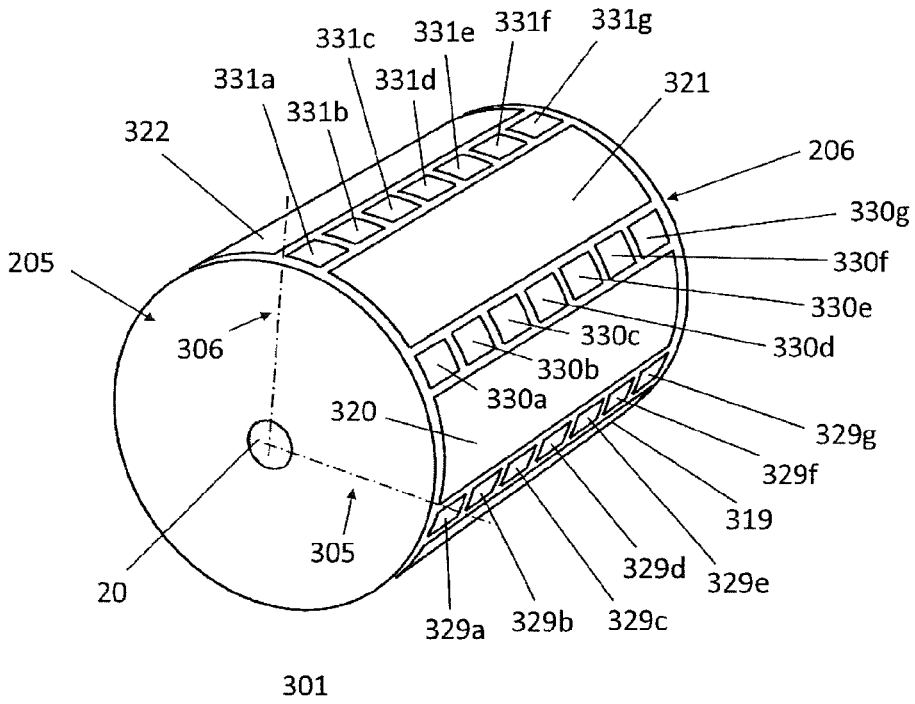
FIG. 13 shows a modified cylindrical cell according to an embodiment of the present invention in which correction electrodes between eight straight mantle electrodes are longitudinally divided into seven segments each, again in order to be able to correct axial components of the electric field disturbances.

FIG. 13 shows as an example a cylindrical ion cyclotron resonance cell 301 with two pairs of excitation electrodes and two pairs of detection electrodes and longitudinal correction electrodes (total of 8) placed between each of them. Each correction electrode in this figure is divided into seven segments. The excitation electrode 320, a segmented correction electrode with the segments 330*a*, 330*b*, 330*c*, 330*d*, 330*e*, 330*f*, 330*g*, a detection electrode 321 and a second segmented correction electrode with the segments 331*a*, 331*b*, 331*c*, 331*d*, 331*e*, 331*f*, 331*g* are fitted within a 90° angle between the dashed-dotted lines 305 and 306. Element 322 is another excitation electrode and element 319 yet another detection electrode, while the electrode divided in segments 329*a*, 329*b*, 329*c*, 329*d*, 329*e*, 329*f* and 329*g* is again a correction electrode.

The process of the asymmetry correction of the electric field can be performed beginning with standard voltage settings at the (correction) electrodes. Initially, an FT-ICR spectrum is acquired and one of the major peaks of interest is chosen as the object of the optimization. Then, further FT-ICR spectra are acquired under varied post capture delay times until a PCD-diagram for the relative intensity of the satellite peak of an even-numbered harmonics with the frequency of $nv_R \pm mv_M$, such as $2v_R \pm 1v_M$, for over at least two periods of the magnetron motion is completed. It is to be mentioned here that the chosen ion does not have to be isolated for the iteration. Measurements can proceed with all available ions within the ICR cell. The PCD curve shows maxima and minima. A delay time in the PCD diagram at or near a maximum of the curve is selected. Keeping this PCD time, now all (correction) electrode voltages are varied in a multidimensional search in order to find an optimum voltage combination that leads to a common minimum of the relative intensities of the even-numbered harmonics with the frequency $nv_R$ and its satellite peak with the frequency $nv_R \pm mv_M$, such as n=2: the second harmonics and m=1: the closest satellite peak. After finding this local common minimum, the obtained voltage values corresponding to this minimum are used and the post capture delay time is varied again, a partial or complete PCD curve is acquired. Then it is checked if the relative intensities of the even-numbered harmonics and the satellite peak at the maxima of the curve are reduced below the values obtained with the previous voltage setting. If they are not reduced in this PCD diagram, one has to go back and pick another point near a maximum at the initial PCD curve and start over again. If the relative intensities of the even-numbered harmonics and the satellite peak at the maxima of the curve are reduced, one starts with another iteration at the new curve's maximum. Again here, a maximum of this PCD curve is selected and the variation of the voltages for a multidimensional search is repeated and optimized again. These iterations are repeated until the global common minimum of the two peaks is found, i.e., the even-numbered harmonics with the frequency $nv_R$ and its satellite peak with the frequency e.g. $nv_R + mv_M$.

The process of the asymmetry correction of the electric field can be automated. A computer program can be used with an algorithm that begins with standard voltage settings at the (correction) electrodes. It acquires FT-ICR spectra, selects one of the major peaks of interest, varies the post capture delay time, acquires again FT-ICR spectra until it completes a PCD-diagram for the relative intensity of the satellite peak of an even-numbered harmonics with the frequency of $nv_R \pm mv_M$, e.g. n=2 and m=1, for over at least two periods of the magnetron motion. The PCD curve shows maxima and minima. The algorithm selects a delay time in the PCD diagram at or near a maximum of the curve. Keeping this PCD time, it now varies all (correction) electrode voltages in a multidimensional search to find an optimum voltage combination that leads to a common minimum of the relative intensities of the even-numbered harmonics with the frequency $nv_R$ and its satellite peak with the frequency $nv_R \pm mv_M$. After finding this local common minimum it uses the obtained voltage values corresponding to this minimum, goes back and varies the post capture delay time, acquires a complete PCD curve, and checks if the relative intensities of the even-numbered harmonics and the satellite peak at the maxima of the curve are reduced below the values obtained with the previous voltage setting. If they are not reduced in this PCD diagram, the program goes back and picks another point near a maximum in the initial PCD curve and starts over again. If the relative intensities of the even-numbered harmonics and the satellite peak at the maxima of the curve are reduced, the program starts another loop at the new curve's maximum. The program again selects a maximum of this PCD curve and repeats the variation of the voltages for a multidimensional search and the optimization again. It repeats these iterative loops until it finds the global common minimum of the two peaks, i.e., the even-numbered harmonics with the frequency $nv_R$ and its satellite peak with the frequency e.g., $nv_R \pm mv_M$.

A slightly different method of the optimization, preferably performed in an automated manner, would be the following: The program acquires FT-ICR spectra, selects one of the major peaks of interest and checks the intensities of an even-numbered harmonics ($nv_R$) and the satellite peaks ($nv_R \pm mv_M$) of the even-numbered harmonics therein in dependence of the compensation voltages. By independently varying the compensation voltages of all available (correction) electrodes the algorithm performs a multidimensional search for a common minimum of these two peaks. After finding the voltages for obtaining minimal peaks, the algorithm goes back and changes now the post capture delay time, then repeats the multidimensional voltage search again and finds the common minimum of the peaks now in dependence of this new delay time, and so on. These iterative loops continue until the global common minimum of the two peaks, i.e., the even-numbered harmonics with the frequency $nv_R$ and its satellite peak with the frequency $nv_R \pm mv_M$ is found.

In complex cases where also axial components of the distorted electric field need to be compensated, the correction algorithm will include the voltage values of the individual segments of the corresponding electrodes.

Such an optimization program can always be applied, if an electric field asymmetry is suspected. Automated runs can also be implemented for diagnostic purposes. Here the program would acquire in periodic times a post capture delay curve just for testing the size (or diameter) and the symmetry of the magnetron motion and deriving the conclusion about the position of the axis of the electric field in the ICR cell.

The invention has been described with reference to various embodiments. It will be understood, however, that various aspects or details of the invention may be changed, or various aspects or details of different embodiments may be arbitrarily combined, if practicable, without departing from the scope of the invention. Generally, the foregoing description is for the purpose of illustration only, and not for the purpose of limiting the invention which is defined solely by the appended claims.

Although the present invention has been illustrated and described with respect to several preferred embodiments thereof, various changes, omissions and additions to the form and detail thereof, may be made therein, without departing from the spirit and scope of the invention.

What is claimed is:

1. A method for detecting an asymmetry of an electric field in an FT-ICR cell in a radial direction relative to an axis of the FT-ICR cell, wherein parameters indicative of a position or a diameter of a center axis of a magnetron motion for an ion with a reduced cyclotron frequency $v_R$ in the ICR cell are determined by monitoring relative intensities of at least one of the ion signals with frequencies of $nv_R$ and ($nv_R \pm mv_M$), $v_M$ being a magnetron frequency, n=2, 4, 6, . . . , and m=1, 2, 3, . . . , as a function of the ion's post capture delay time, and by evaluating maxima and minima of the relative intensities.

2. A method for correcting an asymmetry of an electric field in an FT-ICR cell with mantle electrodes, wherein parameters indicative of a position or a diameter of a center axis of a magnetron motion for an ion with a reduced cyclotron frequency $v_R$ in the ICR cell are determined by monitoring, over several measurements, relative intensities of at least one of the ion signals with frequencies of $nv_R$ and $(nv_R \pm mv_M)$, $v_M$ being a magnetron frequency, n=2, 4, 6, . . . , and m=1, 2, 3, . . . , as a function of the ion's post capture delay time, and by evaluating maxima and minima of the relative intensities, and wherein an intensity of a maximum of at least one of an even-numbered harmonics peak for the ion with frequency $v_R$ with frequency $nv_R$ and a satellite peak with a frequency of $(nv_R \pm mv_M)$ is minimized by adjusting compensation voltages at one or more of the mantle electrodes of the FT-ICR cell.

3. The method according to claim 2, wherein the FT-ICR cell is a dynamically harmonized FT-ICR cell with leaf and inverse leaf electrodes, and wherein DC voltage values at the inverse leaf electrodes are individually varied for the correction of the electric field asymmetry.

4. The method according to claim 3, wherein some of the leaf electrodes are split.

5. The method according to claim 3, wherein the DC voltage values at the inverse leaf electrodes are varied independent of each other until a common minimum of the even-numbered harmonics peak with the frequency of $nv_R$ and its satellite peak with the frequency of $(nv_R \pm mv_M)$ is found.

6. The method according to claim 3, wherein the relative intensities of the peaks with the measured frequencies of $(nv_R \pm mv_M)$ and $nv_R$ are reduced in dependence of the ion's post capture delay time by changing the independently variable DC voltage values at the inverse leaf electrodes and varying the post capture delay time.

7. The method according to claim 2, wherein the FT-ICR cell is a conventional FT-ICR cell with excitation and detection electrodes and DC voltage values at the excitation and detection electrodes are individually varied for the correction of the electric field asymmetry.

8. The method according to claim 2, wherein the FT-ICR cell is a conventional FT-ICR cell with excitation and detection electrodes, and the relative intensities of the peaks with the measured frequencies of $(nv_R \pm mv_M)$ and $nv_R$ are optimized in dependence of the post capture delay time for the correction of the electric field asymmetry by changing independently variable DC voltage values at the excitation and detection electrodes of the FT-ICR cell and varying the post capture delay time.

9. The method according to claim 2, wherein an iterative correction process is performed, comprising:

a) initially keeping the mantle electrodes, to which compensation voltages can be applied, at standard voltage settings for FT-ICR operation, b) acquiring FT-ICR spectra and varying the post capture delay (PCD) time by a predefined step size throughout so that a PCD curve is obtained for at least two magnetron periods, c) selecting a PCD time at or close to a maximum of the obtained curve, d) varying the compensation voltages at the electrodes in a multidimensional search in order to find an optimum voltage combination for a common minimum of the relative intensities of the even-numbered harmonics peak with frequency $nv_R$ and a satellite peak with frequency $nv_R \pm mv_M$, e) determining a local minimum of the relative intensities, f) acquiring a new PCD curve using the voltage values for the minimum at least for two magnetron periods, g) determining whether the relative intensities of the even-numbered harmonics and the satellite peak at the maxima of the new PCD curve are reduced below the values obtained with the previous voltage setting, h) if the values are not reduced, choosing a new point near a maximum at the initial PCD curve and starting again the optimization at step (d), i) if the values are reduced, continuing the search using the voltage values for the minimum by going back to step (c) and starting a next loop, and j) repeating the iterations of steps (h) and (i) until a global common minimum of the even-numbered harmonics with frequency $nv_R$ and its satellite peak with frequency $(nv_R \pm mv_M)$ is found.

10. The method according to claim 2, wherein the correction process of the electric field in the ICR cell comprises a) setting standard voltages for ICR operation at the mantle electrodes and a starting post capture delay time, and acquiring an FT-ICR spectrum, b) varying the voltages of the mantle electrodes, to which compensation voltages can be applied, in a multidimensional search to find an optimum voltage combination for a common minimum of the relative intensities of the even-numbered harmonics with frequency $nv_R$ and a satellite peak with frequency $(nv_R \pm mv_M)$, c) finding a local minimum of the relative intensities, d) varying the post capture delay time, and e) going back to step (b) using the obtained voltage values corresponding to this minimum, starting a next loop and repeating these iterations until a global common minimum of the even-numbered harmonics with frequency $nv_R$ and its satellite peak with frequency $(nv_R \pm mv_M)$ is found.

11. A dynamically harmonized FT-ICR cell comprising leaf-shaped and complementary inverse leaf-shaped electrodes, wherein each inverse leaf-shaped electrode is connected to a DC voltage source so that a DC voltage supplied thereto is independently tunable as to provide each inverse leaf-shaped electrode with an individual compensation voltage for correcting an asymmetric electric field in the FT-ICR cell.

12. The dynamically harmonized FT-ICR cell according to claim 11, wherein each inverse leaf-shaped electrode is paired with one adjacent inverse leaf electrode, and wherein each pair is jointly connected to a tunable DC voltage source as to provide each pair of inverse leaf-shaped electrodes with an individual joint compensation voltage for correcting an asymmetric electric field in the FT-ICR cell.

13. The dynamically harmonized FT-ICR cell according to claim 11, wherein the inverse leaf-shaped electrodes are segmented longitudinally, each segment being connected to a DC voltage source so that a DC voltage supplied thereto is independently tunable as to provide each segment with an individual compensation voltage for correcting an axially asymmetric electric field, or a non-uniform perturbation of the electric field axis, in the FT-ICR cell.

14. The dynamically harmonized FT-ICR cell according to claim 13, wherein each segment of an inverse leaf-shaped electrode is paired with a corresponding segment of one adjacent inverse leaf-shaped electrode and jointly connected to a tunable DC voltage source as to provide each pair of segments with an individual joint compensation voltage for correcting an axially asymmetric electric field, or a non-uniform perturbation of the electric field axis, in the FT-ICR cell.

15. An FT-ICR cell comprising excitation electrodes configured to excite a cyclotron motion of ions within the FT-ICR cell and detection electrodes configured to detect image current transients induced by the ions as they repeatedly pass the detection electrodes, wherein each excitation and detection electrode is connected to a DC voltage source so that a DC voltage supplied thereto is independently tunable as to provide each excitation and detection electrode with an individual compensation voltage for correcting an asymmetric electric field in the FT-ICR cell.

16. The FT-ICR cell according to claim 15, wherein the excitation electrodes are grouped in two or more pairs of adjacent excitation electrodes and the detection electrodes are grouped in two or more pairs of adjacent detection electrodes.

17. The FT-ICR cell according to claim 15, wherein a pattern of compensation voltages applied to at least one of the excitation electrodes and detection electrodes is not homogenous.

18. An FT-ICR cell comprising excitation electrodes configured to excite a cyclotron motion of ions within the FT-ICR cell and detection electrodes configured to detect image current transients induced by the ions as they repeatedly pass the detection electrodes, further comprising longitudinal correction electrodes positioned between the excitation and detection electrodes, each longitudinal correction electrode being connected to a DC voltage source so that a DC voltage supplied thereto is independently tunable as to provide each longitudinal correction electrode with an individual compensation voltage for correcting an asymmetric electric field in the FT-ICR cell.

19. The FT-ICR cell according to claim 18, wherein the correction electrodes between the excitation and detection electrodes are segmented longitudinally, each segment being connected to a DC voltage source so that a DC voltage supplied thereto is independently tunable as to provide each segment with an individual compensation voltage for correcting an axially asymmetric electric field, or a non-uniform perturbation of the electric field axis, in the FT-ICR cell.

20. The FT-ICR cell according to claim 18, wherein the correction electrodes have a smaller width than the excitation and detection electrodes.

* * * * *